US011348523B2

(12) United States Patent
Chen et al.

(10) Patent No.: US 11,348,523 B2
(45) Date of Patent: May 31, 2022

(54) DISPLAY SUBSTRATE, DISPLAY PANEL AND DISPLAY APPARATUS

(71) Applicant: BOE Technology Group Co., Ltd., Beijing (CN)

(72) Inventors: Liang Chen, Beijing (CN); Lei Wang, Beijing (CN); Li Xiao, Beijing (CN); Minghua Xuan, Beijing (CN); Dongni Liu, Beijing (CN); Hao Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/271,737

(22) PCT Filed: Jul. 29, 2020

(86) PCT No.: PCT/CN2020/105452

§ 371 (c)(1),
(2) Date: Feb. 26, 2021

(87) PCT Pub. No.: WO2021/018180

PCT Pub. Date: Feb. 4, 2021

(65) Prior Publication Data

US 2021/0319748 A1 Oct. 14, 2021

(30) Foreign Application Priority Data

Jul. 29, 2019 (CN) ..... 201910689209.6

(51) Int. Cl.
*G09G 3/3233* (2016.01)

(52) U.S. Cl.
CPC ... *G09G 3/3233* (2013.01); *G09G 2300/0426* (2013.01)

(58) Field of Classification Search
CPC ..... G09G 3/3233; G09G 2300/0426
See application file for complete search history.

(56) References Cited

U.S. PATENT DOCUMENTS 7,847,765 B2 12/2010 Park et al.
8,330,685 B2 12/2012 Park et al.
(Continued)

FOREIGN PATENT DOCUMENTS

CN 1779765 A 5/2006
CN 1801298 A 7/2006
(Continued)

OTHER PUBLICATIONS

First Office Action, including Search Report, for Chinese Patent Application No. 201910689209.6, dated Jul. 3, 2020, 14 pages.
(Continued)

*Primary Examiner* — Stacy Khoo
(74) *Attorney, Agent, or Firm* — Westman, Champlin & Koehler, P.A.

(57) ABSTRACT

A display substrate, includes: a plurality of pixel driving circuits; a plurality of groups of light-emitting driving signal lines, wherein each driving signal line group of the plurality of groups of light-emitting driving signal lines includes a plurality of light-emitting driving signal lines; and a plurality of pixel circuit multiplexing units coupled to the plurality of pixel driving circuits, respectively, wherein each pixel circuit multiplexing unit includes N light-emitting units coupled to one of the plurality of pixel driving circuits and a group of light-emitting driving signal line.

13 Claims, 18 Drawing Sheets

(56) References Cited

U.S. PATENT DOCUMENTS

| | | | | |
|---|---|---|---|---|
| 9,501,970 | B2 | 11/2016 | Park et al. | |
| 9,934,719 | B2 | 4/2018 | Wang et al. | |
| 10,510,294 | B2 | 12/2019 | Yang et al. | |
| 10,839,748 | B2 | 11/2020 | Kim et al. | |
| 10,923,036 | B2 | 2/2021 | Lee | |
| 2006/0145964 | A1 | 7/2006 | Park et al. | |
| 2010/0283776 | A1 | 11/2010 | Park et al. | |
| 2013/0069854 | A1 | 3/2013 | Park et al. | |
| 2014/0111406 | A1 | 4/2014 | Wang et al. | |
| 2016/0019835 | A1 | 1/2016 | Han | |
| 2016/0191952 | A1 | 6/2016 | Kim et al. | |
| 2017/0103700 | A1 | 4/2017 | Wang et al. | |
| 2017/0200412 | A1 | 7/2017 | Gu et al. | |
| 2018/0151125 | A1 | 5/2018 | Lee | |
| 2018/0293942 | A1 | 10/2018 | Gu et al. | |
| 2019/0206319 | A1 | 7/2019 | Kim et al. | |
| 2019/0340979 | A1 | 11/2019 | Yang et al. | |
| 2020/0185481 | A1* | 6/2020 | Park | H01L 27/3265 |
| 2020/0302860 | A1* | 9/2020 | Kim | G09G 3/3266 |
| 2020/0335561 | A1* | 10/2020 | Huang | G06F 1/1626 |

FOREIGN PATENT DOCUMENTS

| | | | | |
|---|---|---|---|---|
| CN | 101216650 | A | 7/2008 | |
| CN | 103065556 | A | 4/2013 | |
| CN | 106297672 | A | 1/2017 | |
| CN | 108122542 | A | 6/2018 | |
| CN | 108885855 | A | 11/2018 | |
| CN | 110010093 | A | 7/2019 | |
| CN | 110379366 | A | 10/2019 | |
| JP | 2003122306 | A | 4/2003 | |
| WO | WO-2018076745 | A1 * | 5/2018 | G09G 3/3266 |

OTHER PUBLICATIONS

Second Office Action, including Search Report, for Chinese Patent Application No. 201910689209.6, dated Dec. 24, 2020, 15 pages.

* cited by examiner

DISPLAY SUBSTRATE, DISPLAY PANEL AND DISPLAY APPARATUS

CROSS-REFERENCE TO RELATED APPLICATION(S)

This application is a Section 371 National Stage Application of International Application No. PCT/CN2020/105452, filed on Jul. 29, 2020, which published as WO 2021/018180 A1 on Feb. 4, 2021, not in English, and claims priority to Chinese Patent Application No. 201910689209.6, filed on Jul. 29, 2019, the disclosures of which are incorporated herein by reference in their entireties.

TECHNICAL FIELD

The present disclosure relates to a field of display, and in particular to a display substrate, a display panel and a display apparatus.

BACKGROUND

Organic light-emitting diode (OLED) panels have a series of advantages, such as active light-emitting, no viewing angle problems, light weight, small thickness, high brightness, high light-emitting efficiency, fast response speed, high dynamic picture quality, wide operating temperature range, flexible display, simple process, low cost, strong anti-seismic ability and so on. Due to the fast response speed of the OLED panel, it can effectively reduce dizziness when used in Virtual Reality (VR) products, and has huge application potential.

SUMMARY

In a first aspect, the present disclosure provides a display substrate, comprising: a plurality of pixel driving circuits; a plurality of groups of light-emitting driving signal lines, wherein each driving signal line group of the plurality of groups of light-emitting driving signal lines comprises a plurality of light-emitting driving signal lines; and a plurality of pixel circuit multiplexing units coupled to the plurality of pixel driving circuits, respectively, wherein the plurality of pixel circuit multiplexing units are arranged in a first array of D×E, and D and E are integers greater than 1, wherein each pixel circuit multiplexing unit of the plurality of pixel circuit multiplexing unit comprises N light-emitting units arranged in a second array of K×H, wherein K, H and N are integers greater than 1, and the N light-emitting units are coupled to one of the plurality of groups of light-emitting driving signal lines; and wherein each light-emitting unit of the N light-emitting units is configured to receive a driving signal from a pixel driving circuit coupled to the each light-emitting unit, under control of a light-emitting driving signal from a light-emitting driving signal line coupled to the each light-emitting unit, so that all light-emitting units located in a same row do not emit light at the same time, all light-emitting units located in a same column emit light at different times, and the N light-emitting units in a same pixel circuit multiplexing unit emit light in sequence during one frame period.

In some embodiment, the plurality of pixel circuit multiplexing units are coupled to the plurality of pixel driving circuits in one-to-one correspondence, and the N light-emitting units in the each pixel circuit multiplexing unit are coupled to a same pixel driving circuit in the plurality of pixel driving circuits.

In some embodiment, the each driving signal line group comprises N light-emitting driving signal lines; and wherein the N light-emitting driving signal lines extend in a first direction and are arranged in a second direction, and the first direction is a row direction of the first array and the second array, and the second direction is a column direction of the first array and the second array; and pixel circuit multiplexing units located in a same row of the first array are coupled to a group of light-emitting driving signal lines.

In some embodiment, N=2, and the each pixel circuit multiplexing unit comprises a first light-emitting unit and a second light-emitting unit arranged in a column, and the N light-emitting driving signal lines comprise a first light-emitting driving signal line and a second light-emitting driving signal line; and wherein a first light-emitting unit in a pixel circuit multiplexing unit located in an $i^{th}$ row and a $j^{th}$ column of the first array and a second light-emitting unit in a pixel circuit multiplexing unit located in the $i^{th}$ row and a $(j+1)^{th}$ column of the first array are coupled to the first light-emitting driving signal line, wherein i and j are integers, and $1 \le i \le D$, $1 \le j \le E$; and a second light-emitting unit in the pixel circuit multiplexing unit located in the $i^{th}$ row and the $j^{th}$ column of the first array and a first light-emitting unit in pixel circuit multiplexing unit located in the $i^{th}$ row and the $(j+1)^{th}$ column of the first array are coupled to the second light-emitting driving signal line.

In some embodiment, the first light-emitting driving signal line and the second light-emitting driving signal line are in a linear shape and extend in the first direction; and wherein each of the first light-emitting unit and the second light-emitting unit is coupled to the first light-emitting driving signal line or the second light-emitting driving signal line through a via hole.

In some embodiment, the first light-emitting driving signal line is in a first zigzag shape and extends in the first direction, so as to couple to the first light-emitting unit in the pixel circuit multiplexing unit located in the $i^{th}$ row and the $j^{th}$ column and the second light-emitting unit in the pixel circuit multiplexing unit located in the $i^{th}$ row and the $(j+1)^{th}$ column; and the second light-emitting driving signal line is in a second zigzag shape and extends in the first direction, so as to couple to the second light-emitting unit in the pixel circuit multiplexing unit located in the $i^{th}$ row and the $j^{th}$ column and the first light-emitting unit in the pixel circuit multiplexing unit located in the $i^{th}$ row and the $(j+1)^{th}$ column.

In some embodiment, N is an even number greater than 2, and the N light-emitting driving signal lines in the each driving signal line group are arranged in the second direction in an order from the first light-emitting driving signal line to the $N^{th}$ light-emitting driving signal line; and wherein a light-emitting unit located in a $k^{th}$ row and an $h^{th}$ column of the second array is coupled to an $n^{th}$ light-emitting driving signal line in the N light-emitting driving signal lines, wherein k, h and N are integers greater than 1, $1 \le k \le K$, $1 \le h \le H$, and $n=(k-1)H+h$.

In some embodiment, the display substrate further comprises: a plurality of groups of light-emitting control lines, wherein the each pixel circuit multiplexing unit is coupled to a group of light-emitting control lines, and each control line group comprises M light-emitting control lines; and wherein the N light-emitting units in the pixel circuit multiplexing unit are divided into M groups of light-emitting units, and the pixel circuit multiplexing unit further comprises M switching circuits; and wherein an $m^{th}$ switching circuit is coupled to an $m^{th}$ light-emitting control line, an $m^{th}$ group of light-emitting units and a pixel driving circuit, and the $m^{th}$ switching circuit is configured to provide a driving current generated by the pixel driving circuit to the $m^{th}$ group of light-emitting units under control of an $m^{th}$ light-emitting control signal from the $m^{th}$ light-emitting control line, wherein M is an integer greater than 1, m is an integer, and $1 \leq m \leq M$.

In some embodiment, the plurality of light-emitting driving signal lines extend in the second direction and are arranged in the first direction, and the M light-emitting control lines extend in the first direction and are arranged in the second direction; and wherein a pixel circuit multiplexing unit located in a same column of the first array is coupled to a group of light-emitting driving signal lines, and a pixel circuit multiplexing unit located in a same row of the first array is coupled to a group of light-emitting control lines.

In some embodiment, M=2, the M light-emitting control lines comprise a first light-emitting control line and a second light-emitting control line; and wherein the M groups of the light-emitting units comprises a first group of light-emitting units and a second group of the light-emitting units, and the M switching circuits comprise a first switching circuit and a second switching circuit; and wherein the first switching circuit comprises a first transistor, a gate of the first transistor is coupled to the first light-emitting control line, a first electrode of the first transistor is coupled to the pixel driving circuit, and a second electrode of the first transistor is coupled to the first group of the light-emitting units; and the second switching circuit comprises a second transistor, a gate of the second transistor is coupled to the second light-emitting control line, a first electrode of the second transistor is coupled to the pixel driving circuit, and a second electrode of the second transistor is coupled to the second group of the light-emitting units.

In some embodiment, the each light-emitting unit of the N light-emitting units comprises: a third transistor having a gate coupled to one of the plurality of light-emitting driving signal lines, and a first electrode coupled to one of the plurality of pixel driving circuits; and a light-emitting device having an anode coupled to a second electrode of the third transistor, and a cathode coupled to a reference signal line.

In some embodiment, the gate of the third transistor is arranged in a gate layer of the display substrate, the first electrode of the third transistor and the second electrode of the third transistor are arranged in a source or a drain layer of the display substrate, and the anode of the light-emitting device is arranged in an anode layer of the display substrate; and wherein the anode of the light-emitting device comprises a protrusion in the anode layer, and wherein the protrusion extends to one of the plurality of light-emitting driving signal lines, and is coupled to the second electrode of the third transistor in the source/drain layer through a via hole.

In some embodiment, a length of a protrusion of an anode of a light-emitting device located in a row and a column is different from a length of a protrusion of an anode of a light-emitting device located in the same row and an adjacent column.

In a second aspect, the present disclosure provides a display panel, comprising a display substrate described above.

In a third aspect, the present disclosure provides a display apparatus, comprising the display panel described above.

DETAILED DESCRIPTION OF EMBODIMENTS

The embodiments of the present disclosure are described in detail below, and examples of the embodiments are shown in the accompanying drawings, in which the same or similar reference signs throughout the present disclosure indicate the same or similar elements or elements with the same or similar functions. The embodiments described below with reference to the accompanying drawings are exemplary and are intended to explain the present disclosure, but cannot be understood as a limitation of the present disclosure.

Figure 1:
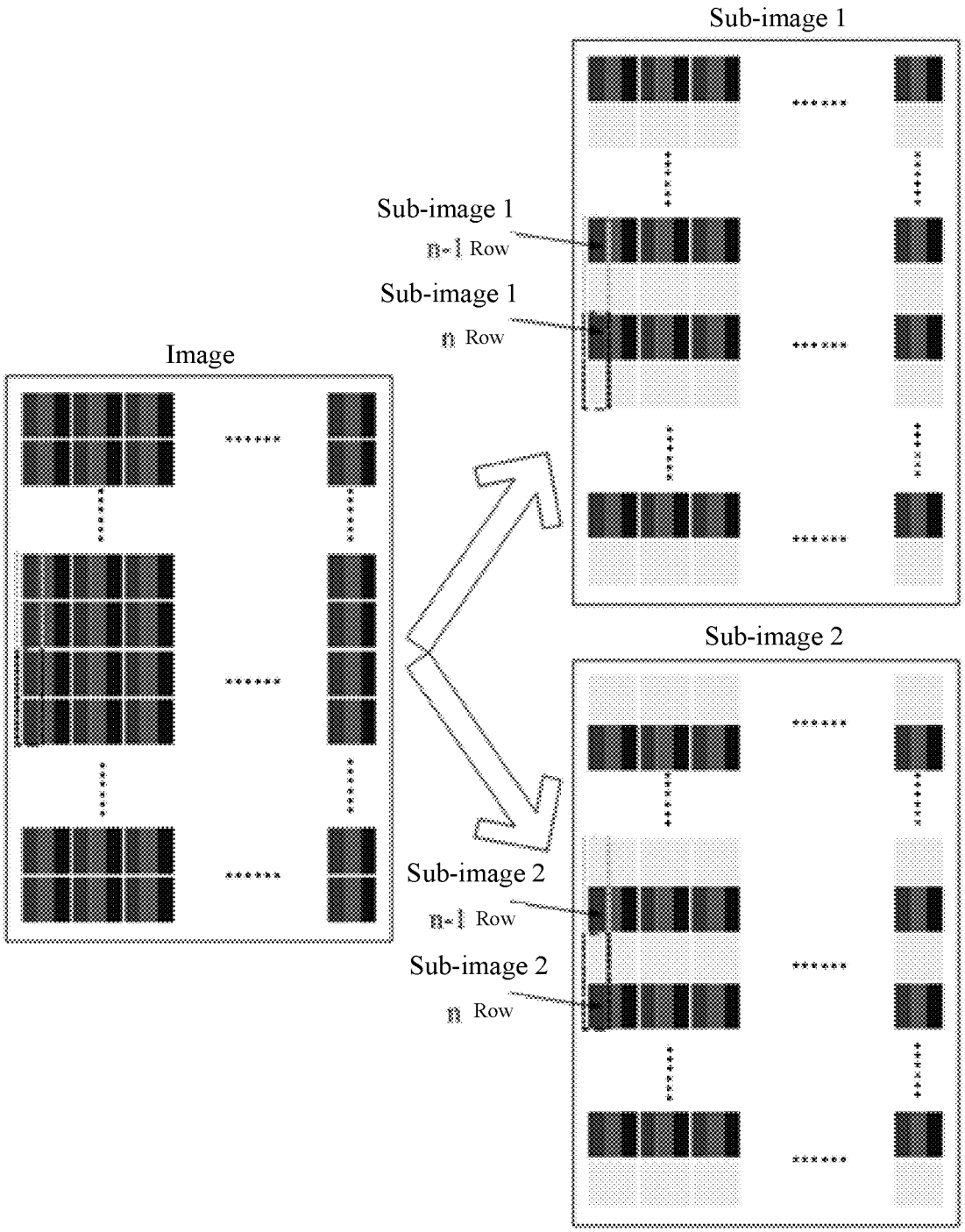
FIG. 1 is a schematic diagram of a 1:2 pixel multiplexing scheme in the related art.
Figure 2:
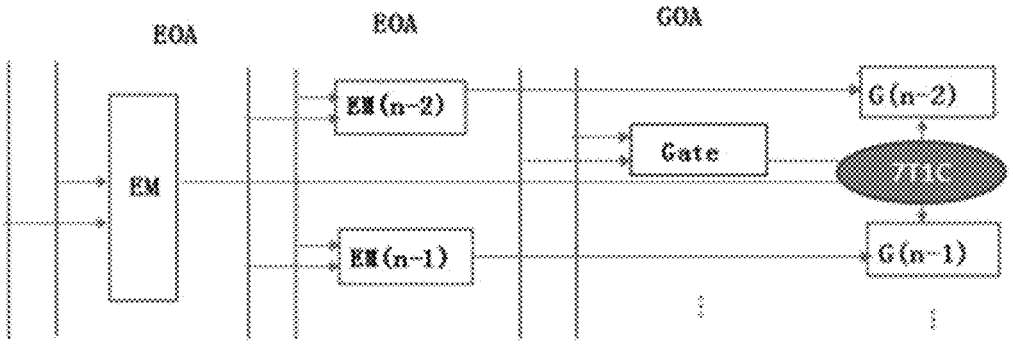
FIG. 2 is a schematic diagram of a pixel multiplexing scheme in the related art.
Figure 3:
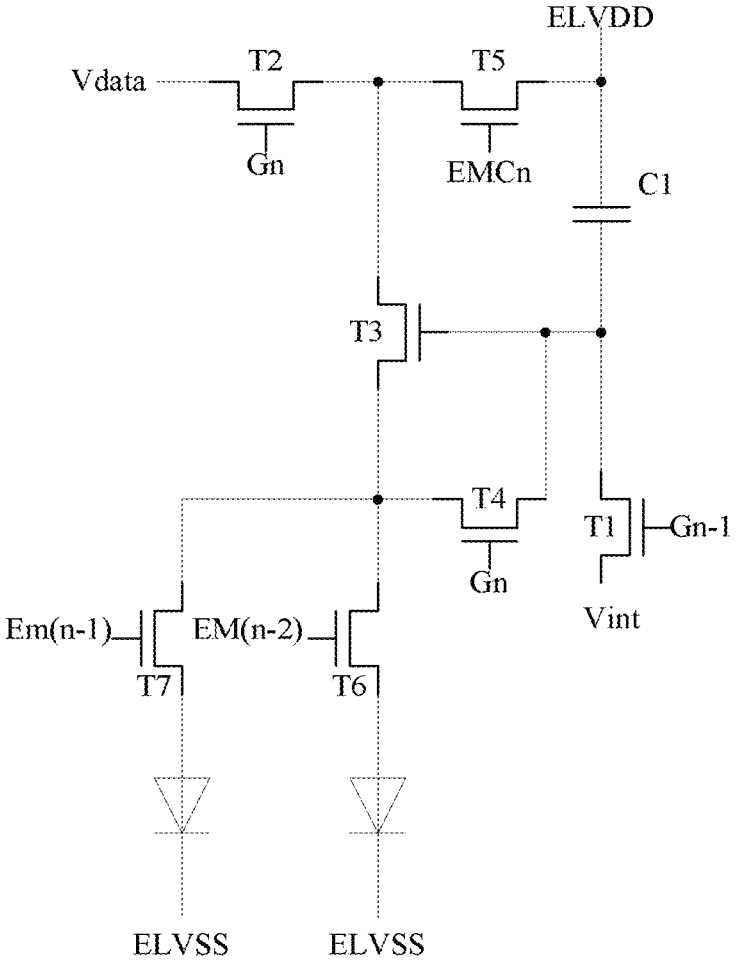
FIG. 3 is a circuit diagram of a pixel circuit in the related art.
Figure 4:
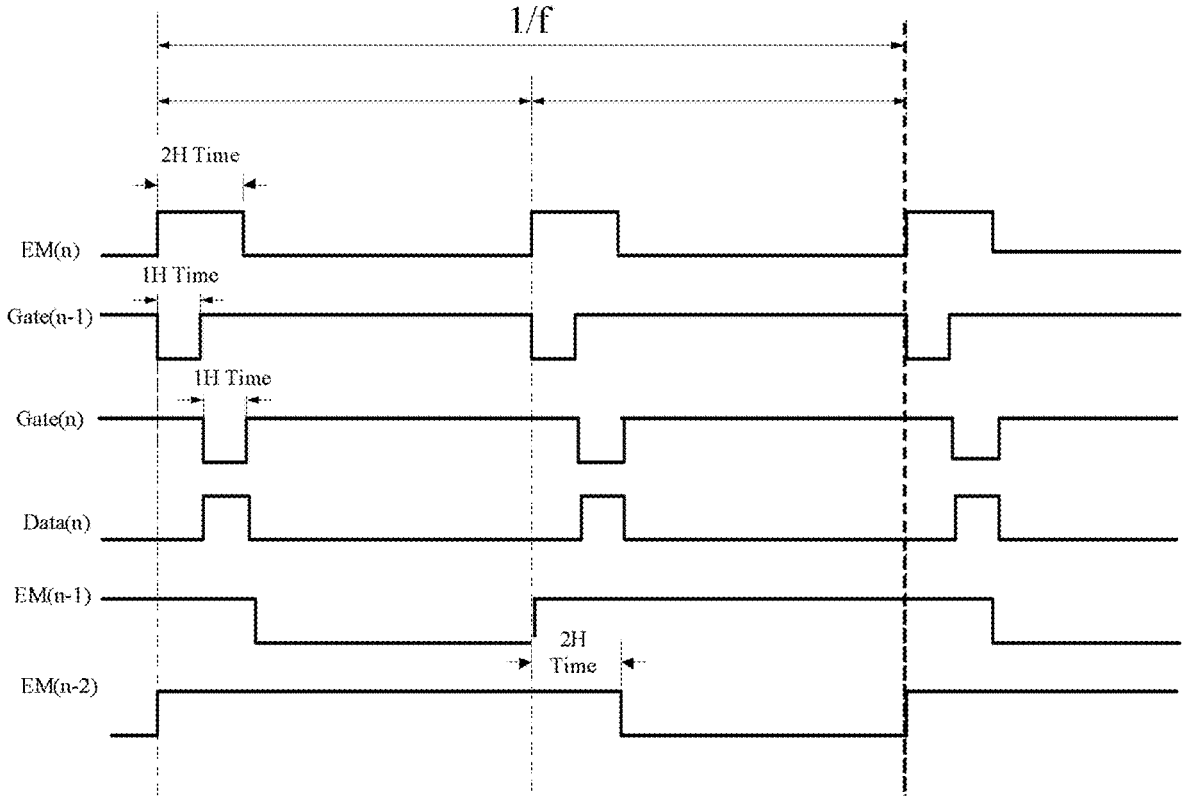
FIG. 4 is an operating sequence of a pixel circuit in the related art.
Figure 5:
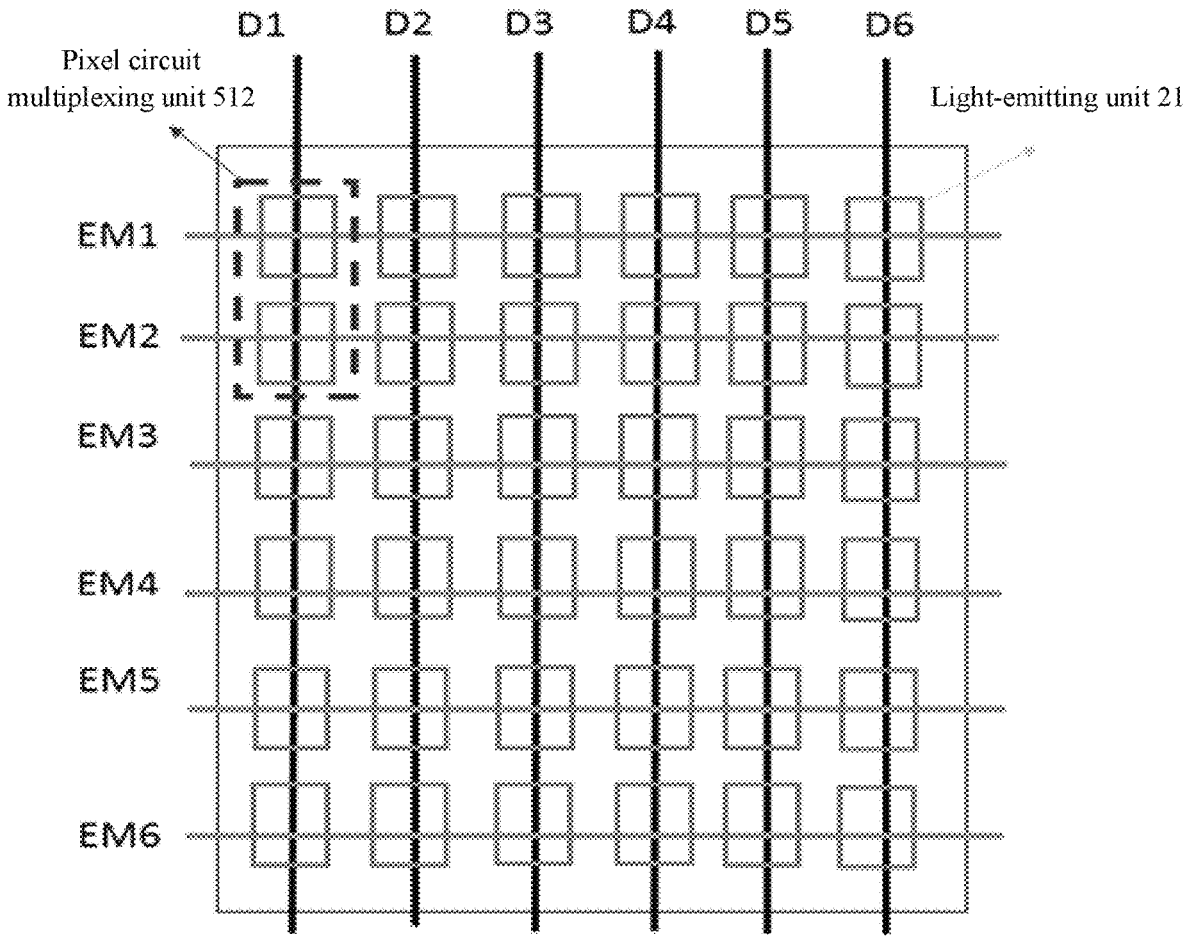
FIG. 5 is a schematic diagram of distributed light-emitting units in a 1:2 pixel multiplexing scheme in the related art.

The following describes a pixel circuit, a display substrate, a display panel and a display apparatus of the embodiments of the present disclosure with reference to the drawings. A pixel multiplexing scheme is that a plurality of light-emitting units share one pixel driving circuit. FIG. 1 is a schematic diagram of a 1:2 pixel multiplexing scheme (two light-emitting units share one pixel driving circuit) in the related art. As shown in FIG. 1, an image is decomposed into a sub-image 1 and a sub-image 2, and the sub-image 1 corresponds to the first row, the third row, the fifth row . . . , that is, odd rows of the image. The sub-image 2 corresponds to the second row, the fourth row, and the sixth row . . . , that is, even rows of the image. In a first half frame during one frame period, the odd rows of light-emitting units are controlled to emit light, so as to display the sub-image 1. In a second half frame during one frame period, the even rows of the light-emitting units are controlled to emit light, so as to display the sub-image 2. The sub-image 1 and the sub-image 2 are superimposed to form a complete image.

As shown in FIG. 2, FIG. 3, FIG. 4 and FIG. 5, according to the 1:2 multiplexing of the Prime-Bridge technology. An $n^{th}$ row of the sub-image 1 and an $n^{th}$ row of the sub-image 2 may share a pixel driving circuit, so as to multiplex a same EM output and a same Gate output. Each sub-pixel in the $n^{th}$ row of sub-image 1 and the $n^{th}$ row of sub-image 2 has corresponding EM switches EM (n−1) and EM (n−2). The pixel circuit for the 1:2 multiplexing of the Prime-Bridge technology corresponds to two sub-pixels, total 7T+1C, which greatly reduces a number of thin film transistors (TFT).

Figure 6:
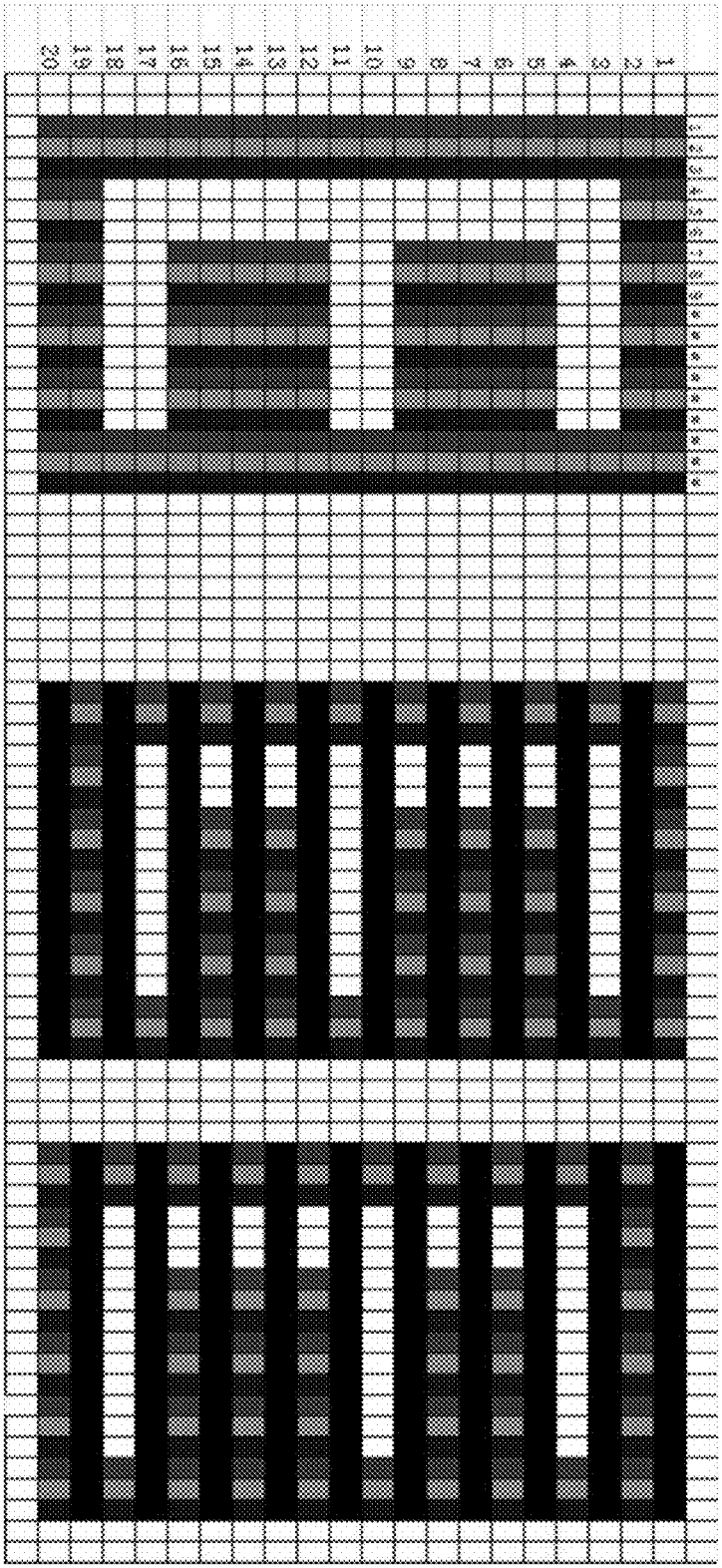
FIG. 6 is a schematic diagram of image decomposition in a 1:2 pixel multiplexing scheme in the related art.
Figure 7:
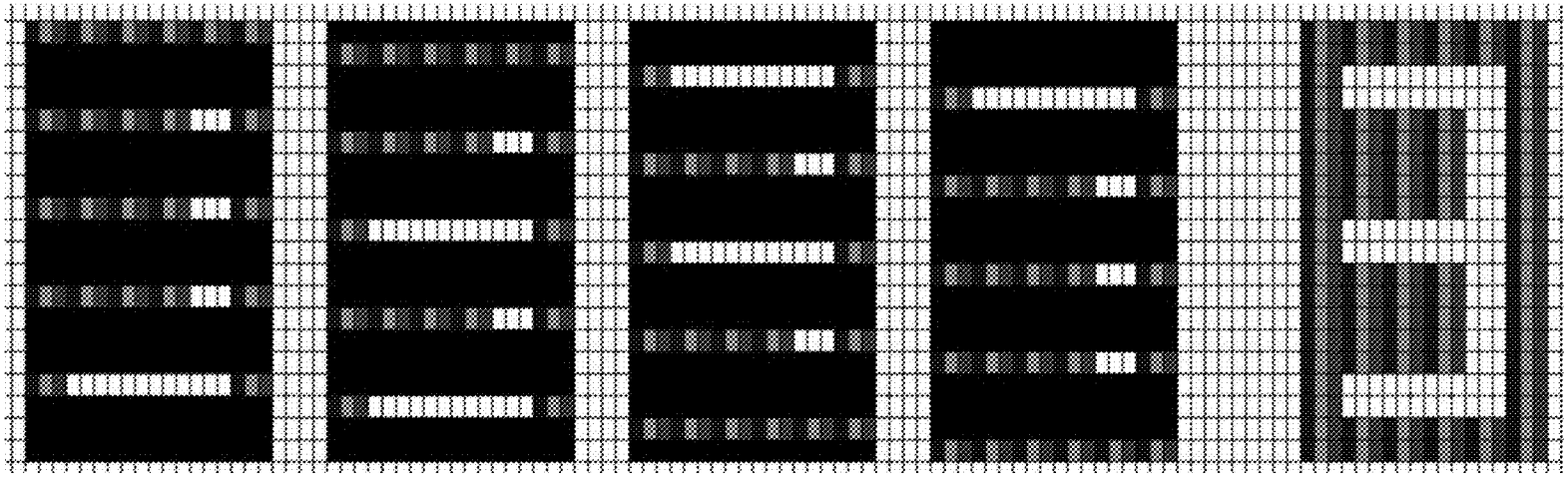
FIG. 7 is a schematic diagram of image decomposition in a 1:4 pixel multiplexing scheme in the related art.

FIG. 6 is a schematic diagram of image decomposition of the 1:2 pixel multiplexing scheme in the related art. As shown in FIG. 6, a decomposed odd-row image is quite different from a decomposed even-row image. Therefore, when the odd-row image and the even-row image are switched between the first half frame and the second half frame, flicker may occur in a vertical direction. FIG. 7 is a schematic diagram of image decomposition of a 1:4 pixel multiplexing scheme in the related art. As shown in FIG. 7, the 1:4 pixel multiplexing scheme has a greater image difference after the image is decomposed, and the flicker may be more serious.

Figure 8:
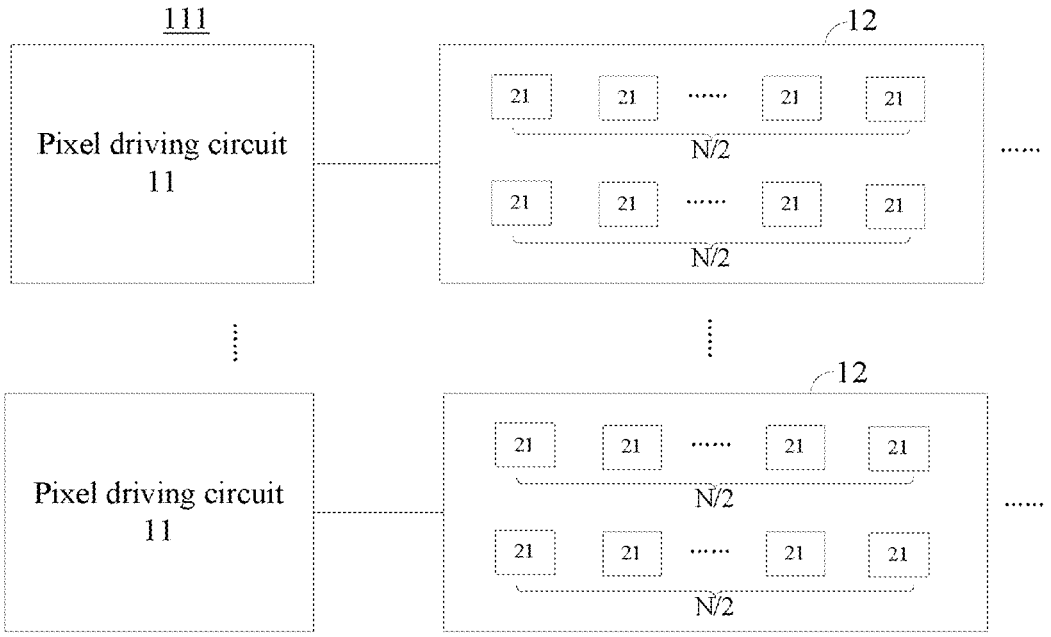
FIG. 8 is a structural diagram of a pixel compensation multiplexing circuit according to the embodiments of the present disclosure.

In order to alleviate the display flicker caused by the pixel multiplexing scheme in the related art, as shown in FIG. 8, the present disclosure provides a pixel circuit 111, the pixel circuit 111 includes: a plurality of pixel driving circuits 11; a plurality of pixel circuit multiplexing units 12 coupled to the pixel driving circuits 11 in one-to-one correspondence. The pixel circuit multiplexing unit 12 is coupled to a corresponding pixel driving circuit 11.

The pixel circuit multiplexing unit 12 includes N light-emitting units 21. N/2 light-emitting units 21 are located in an $m^{th}$ column to an $(m+i)^{th}$ column, respectively, and located in an $n^{th}$ row, and the other N/2 light-emitting units 21 are located in the $m^{th}$ column to the $(m+i)^{th}$ column, respectively, and located in an $(n+1)^{th}$ row, N is an even number greater than 0, n is an odd number, i is equal to N/2−1, all light-emitting units in a same row do not emit light at the same time, and all light-emitting units in a same column do not emit light at the same time.

Figure 11:
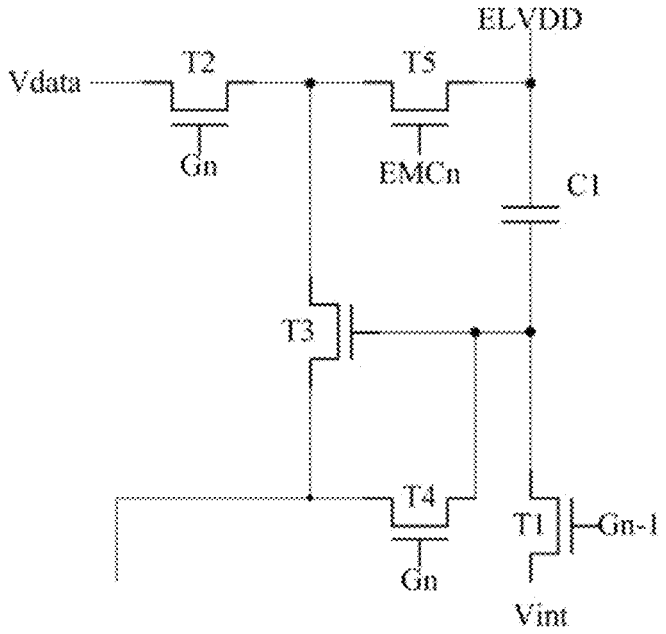
FIG. 11 is a circuit diagram of a pixel driving circuit according to the embodiments of the present disclosure.

In the embodiments of the present disclosure, as shown in FIG. 8, the N light-emitting units 21 in the pixel circuit multiplexing unit 12 are arranged in two rows, that is, the $n^{th}$ row (an odd row) and the $(n+1)^{th}$ row (an even row). N/2 light-emitting units 21 are located in the $n^{th}$ row, and N/2 light-emitting units 21 are located in the $(n+1)^{th}$ row. All the light-emitting units 21 in the same row do not emit light at the same time, and all the light-emitting units 21 in the same column do not emit light at the same time, which may realize a 1:N pixel multiplexing scheme. Since N is an even number greater than 0, the embodiments of the present disclosure may realize 1:2, 1:4, 1:6 . . . pixel multiplexing schemes. As shown in FIG. 11, the pixel driving circuit 11 includes TFTs T1, T2, T3, T4, T5 and a capacitor C1.

According to the pixel circuit 111 provided by the embodiments of the present disclosure, as shown in FIG. 8, the pixel circuit multiplexing unit 12 is coupled to the pixel driving circuit 11 in one-to-one correspondence. The pixel circuit multiplexing unit 12 includes N light-emitting units 21, in which the N/2 light-emitting units 21 are located in the $m^{th}$ column to the $(m+i)^{th}$ column, respectively, and located in the $n^{th}$ row, and the other N/2 light-emitting units 21 are located in the $m^{th}$ column to the $(m+i)^{th}$ column, respectively, and located in the $(n+1)^{th}$ row, N is an even number greater than 0, n is an odd number, i is equal to N/2−1, all light-emitting units in a same row do not emit light at the same time, and all light-emitting units in a same column do not emit light at the same time, which may realize the decomposition display of the image in the horizontal and vertical directions, and reduce the display flicker.

Further, on the basis of the embodiments described above, the N light-emitting units in a same pixel circuit multiplexing unit may emit light in sequence during one frame period.

Further, on the basis of the embodiments described above, N light-emitting units in a same row adjacent to each other may emit light in sequence during one frame period.

Figure 9:
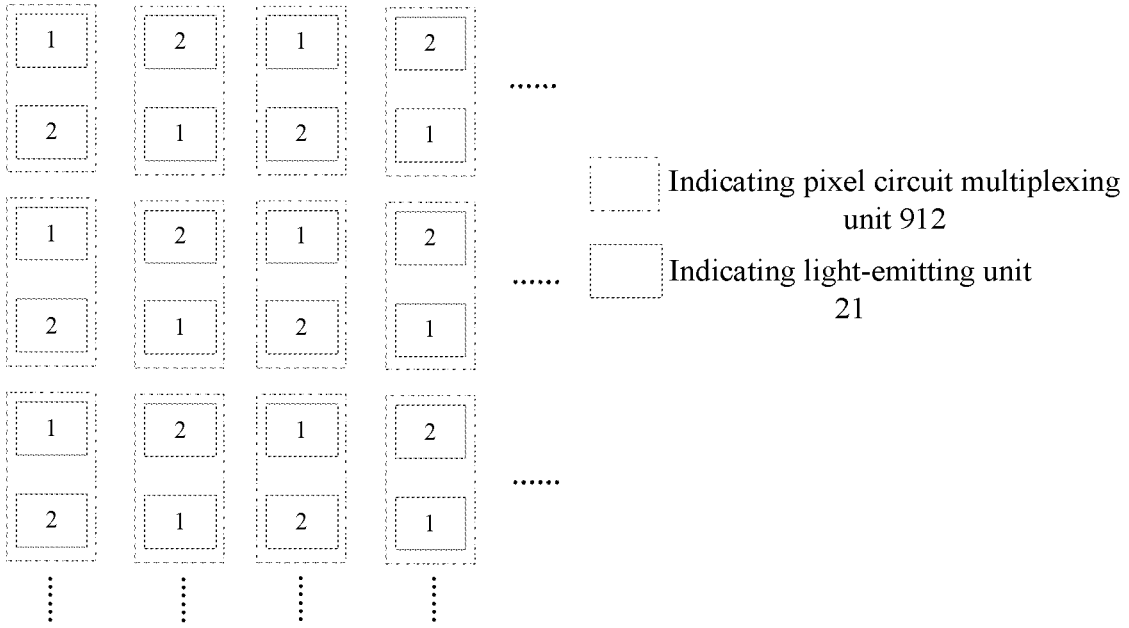
FIG. 9 is an arrangement and a light-emitting sequence of light-emitting units according to the embodiments of the present disclosure.
Figure 10:
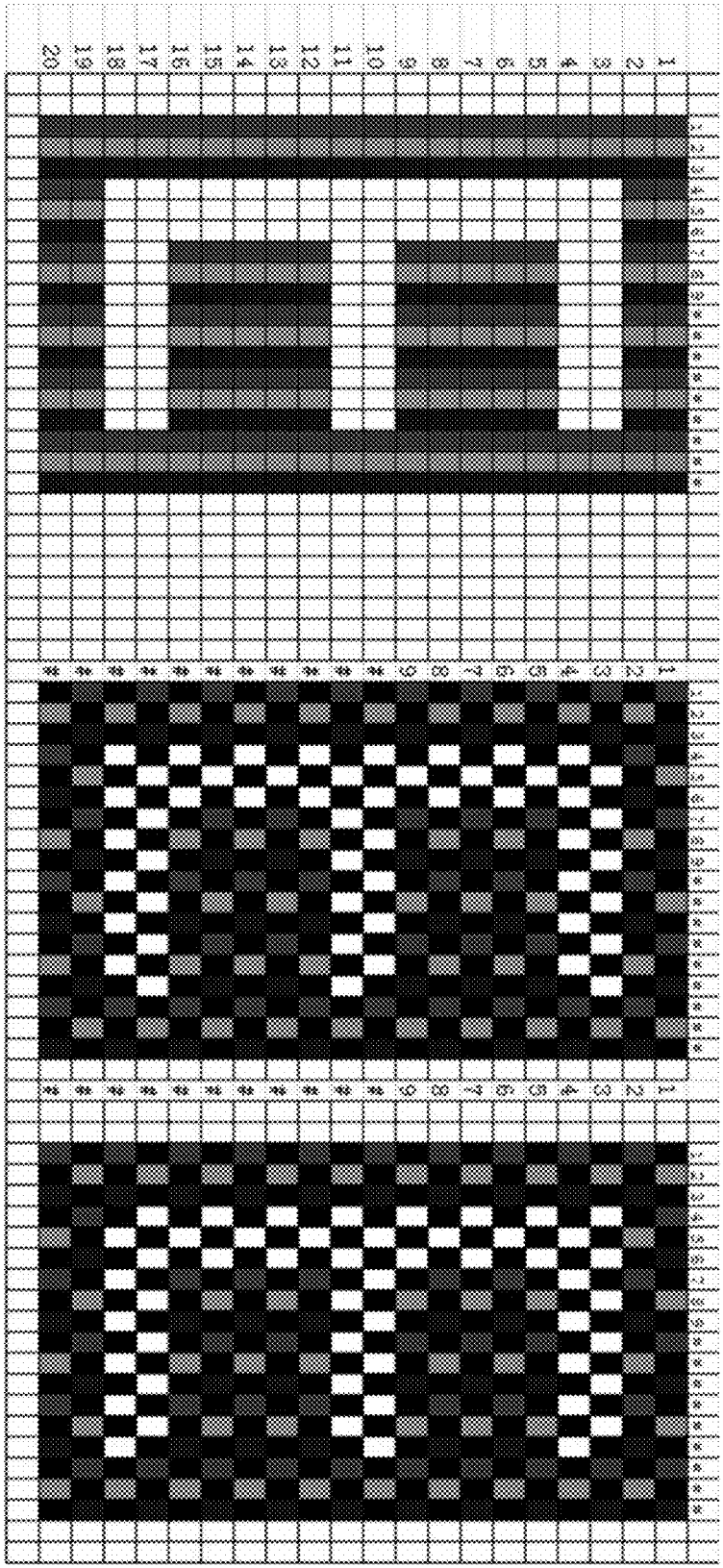
FIG. 10 is an image decomposition diagram according to the embodiments of the present disclosure.

Taking N=2 as an example, when N=2, i=0, the plurality of pixel circuit multiplexing units 912 may be arranged as shown in FIG. 9. The two light-emitting units in a same pixel circuit multiplexing unit emit light in sequence during one frame period, and the two adjacent light-emitting units in a same row emit light in sequence during one frame period. As shown in FIG. 9, the light-emitting units 21 with same identifications emit light at the same time (that is, the light-emitting units 21 of identifications 1 emit light at the same time and the light-emitting units 21 of identifications 2 emit light at the same time). The light-emitting units 21 of identifications 1 and the light-emitting units 21 of identifications 2 emit light in sequence. A display appearance is shown in FIG. 10, which may realize the decomposition display of the image in the horizontal and vertical directions, and reduce the display flicker.

In addition, when N is equal to 2, the display substrate further includes: two light-emitting driving signal lines. The two light-emitting driving signal lines are coupled to two light-emitting units in one-to-one correspondence. Two adjacent light-emitting units in a same row are coupled to the two light-emitting driving signal lines in one-to-one correspondence.

The present disclosure provides a display substrate including: a plurality of pixel driving circuits; a plurality of groups of light-emitting driving signal lines, and each driving signal line group of the plurality of groups of light-emitting driving signal lines comprises a plurality of light-emitting driving signal lines; and a plurality of pixel circuit multiplexing units coupled to the plurality of pixel driving circuits in one-to-one correspondence. The plurality of pixel circuit multiplexing units are arranged in a first array of D×E, and D and E are integers greater than 1, and each pixel circuit multiplexing unit in the plurality of pixel circuit multiplexing unit comprises N light-emitting units arranged in a second array of K×H, and K, H and N are integers greater than 1. The N light-emitting units are coupled to one of the plurality of pixel driving circuits. The N light-emitting units are coupled to one of the plurality of groups of light-emitting driving signal lines. Each light-emitting unit of the N light-emitting units is configured to receive a driving signal from one of the plurality of pixel driving circuits coupled to the each light-emitting unit, under control of a light-emitting driving signal from a light-emitting driving signal line coupled to the each light-emitting unit, so that all light-emitting units located in a same row do not emit light at the same time, all light-emitting units located in a same column emit light at different times, and the N light-emitting units in a same pixel circuit multiplexing unit emit light in sequence during one frame period.

In some embodiments, the each driving signal line group includes N light-emitting driving signal lines. The N light-emitting driving signal lines extend in a first direction and are arranged in a second direction. The first direction is a row direction of the first array and the second array, and the second direction is a column direction of the first array and the second array. A group of light-emitting driving signal lines are coupled to a pixel circuit multiplexing unit located in a same row of the first array.

For example, N=2, and the each pixel circuit multiplexing unit comprises a first light-emitting unit and a second light-emitting unit arranged in a column. The N light-emitting driving signal lines comprise a first light-emitting driving signal line and a second light-emitting driving signal line. A first light-emitting unit in a pixel circuit multiplexing unit located in an $i^{th}$ row and a $j^{th}$ column of the first array and a second light-emitting unit in a pixel circuit multiplexing unit located in the $i^{th}$ row and a $(j+1)^{th}$ column of the first array are coupled to the first light-emitting driving signal line, and i and j are integers, and $1 \le i \le D$, $1 \le j \le E$. A second light-emitting unit in the pixel circuit multiplexing unit located in the $i^{th}$ row and the $j^{th}$ column of the first array and a first light-emitting unit in pixel circuit multiplexing unit located in the $i^{th}$ row and the $(j+1)^{th}$ column of the first array are coupled to the second light-emitting driving signal line.

Figure 12:
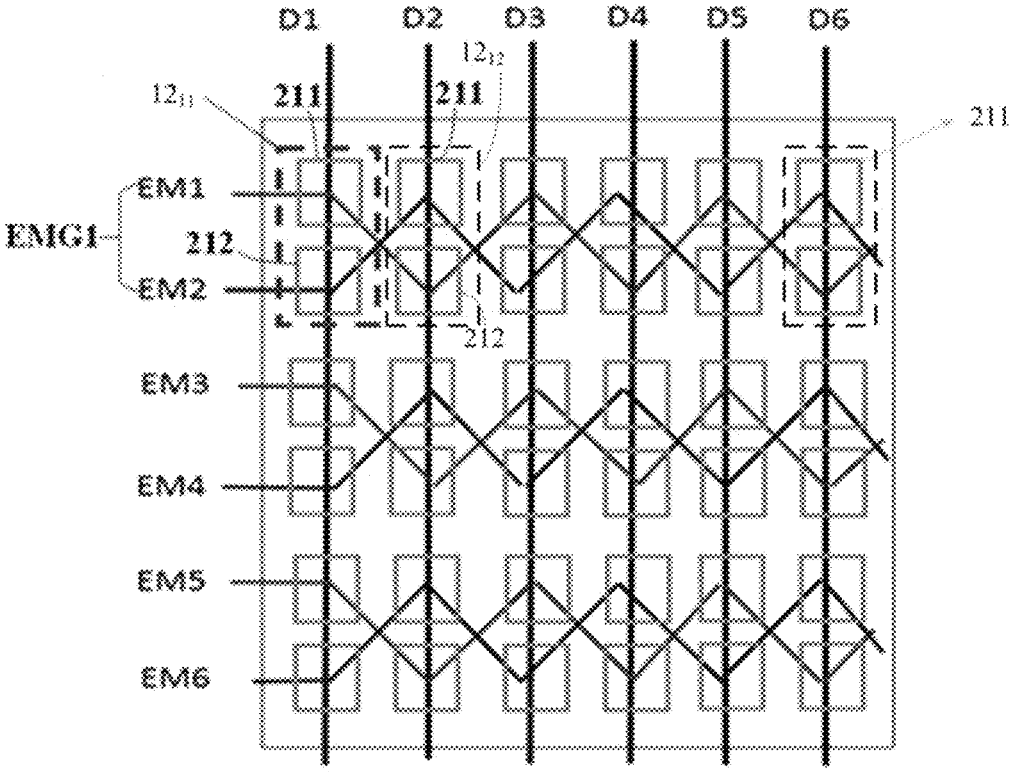
FIG. 12 is a structural diagram of a pixel circuit multiplexing unit according to the embodiments of the present disclosure.

As shown an example of the first array in FIG. 12, N=2, D=3 and E=6, thus the first array includes 3 rows and 6 columns. A pixel circuit multiplexing unit $\mathbf{12}_{11}$ located in a first row and a first column of the first array includes a first light-emitting unit 211 and a second light-emitting unit 212 arranged in a column. A first group of light-emitting driving signal lines EMG1 coupled to the pixel circuit multiplexing unit $\mathbf{12}_{11}$ include a first light-emitting driving signal line EM1 and a second light-emitting driving signal line EM2. First light-emitting driving signal lines and second driving signal lines in other groups of light-emitting driving signal lines are indicated by other reference signs. For example, EM3 and EM4 may be indicated for a second row of the first array. The first light-emitting unit 211 in the pixel circuit multiplexing unit $\mathbf{12}_{11}$ located in the first row and first column of the first array and the second light-emitting unit 212 in the pixel circuit multiplexing unit $\mathbf{12}_{12}$ located in the first row and the second column of the first array are coupled to the first light-emitting driving signal line EM1. The second light-emitting unit 212 in the pixel circuit multiplexing unit $\mathbf{12}_{11}$ located in the first row and first column of the first array and the first light-emitting unit 211 in the pixel circuit multiplexing unit $\mathbf{12}_{12}$ located in the first row and the second column of the first array are coupled to the second light-emitting driving signal line EM2. Similarly, in other groups of pixel circuit multiplexing units $\mathbf{12}_{ij}$, a similar coupling method is adopted to couple the N light-emitting driving signal lines, $1<i \le D$, $1<j \le E$.

In some embodiments, as shown in FIG. 12, the first light-emitting driving signal line EM1 is in a first zigzag shape and extends in the first direction, so as to couple to the first light-emitting unit 211 in the pixel circuit multiplexing unit $\mathbf{12}_{11}$ located in the first row and first column and the second light-emitting unit 212 in the pixel circuit multiplexing unit $\mathbf{12}_{12}$ located in the first row and second column. The second light-emitting driving signal line EM2 is in a second zigzag shape and extends in the first direction, so as to couple to the second light-emitting unit 212 in the pixel circuit multiplexing unit $\mathbf{12}_{11}$ located in the first row and first column and the first light-emitting unit 211 in the pixel circuit multiplexing unit $\mathbf{12}_{12}$ located in the first row and second column.

For example, EM1 and EM2 are in a zigzag shape, and are respectively coupled to two light-emitting units in the pixel circuit multiplexing unit through different layer metal wiring. As shown in FIG. 12, a first light-emitting unit 211 in a pixel circuit multiplexing unit $\mathbf{12}_{11}$ located in the first row and the first column and a first light-emitting unit 211 in a pixel circuit multiplexing unit $\mathbf{12}_{12}$ located in the first row and the second column are respectively coupled to the first light-emitting driving signal line EM1 and the second light-emitting driving signal line EM2 in one-to-one correspondence. In a process of row-scanning, still during a same frame period, the odd rows are scanned first, and then the even rows are scanned, so that two light-emitting units in a same pixel circuit multiplexing unit emit light in sequence during one frame period, and two adjacent light-emitting units in a same row emit light in sequence during one frame period, so as to realize the decomposition display of the image in the horizontal and vertical directions, and reduce the display flicker.

By designing the light-emitting driving signal line into a zigzag shape, two light-emitting units in a same pixel circuit multiplexing unit emit light in sequence during one frame period, and two adjacent light-emitting units in a same row emit light in sequence during one frame period.

In some other embodiments, the each driving signal line group includes N light-emitting driving signal lines, and N is an even number greater than 2. The N light-emitting driving signal lines in the each driving signal line group are arranged in the second direction in an order from the first light-emitting driving signal line to the $N^{th}$ light-emitting driving signal line; and a light-emitting unit located in a $k^{th}$ row and an $h^{th}$ column of the second array is coupled to an $n^{th}$ light-emitting driving signal line in the N light-emitting driving signal lines, and k, h and N are integers greater than 1, $1 \le k \le K$, $1 \le h \le H$, and $n=(k-1)H+h$.

Figure 13:
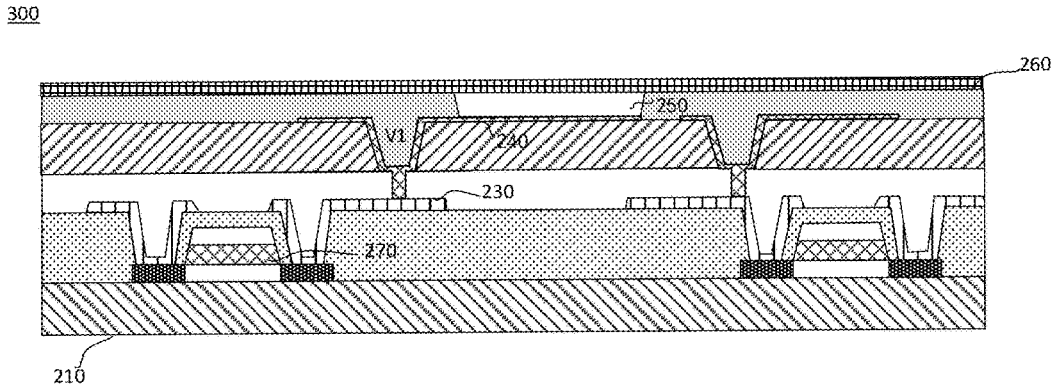
FIG. 13 is a structural diagram of a display substrate in the related art.

FIG. 13 shows an exemplary local film structure diagram of a display substrate in the related art. The display substrate 300 includes: a base substrate 210; a gate layer 270 arranged on the base substrate 210; a source or a drain layer 230 arranged on a side of the gate layer 270 away from the base substrate 210; an anode layer 240 located on a side of the source or the drain layer 230 away from the base substrate 210, and electrically coupled to the source or the drain layer 230 through a via hole V1; a cathode layer 260 located on a side of the anode layer 240 away from the base substrate 210; and a light-emitting material layer 250 located between the anode layer 240 and the cathode layer 260.

Figure 14:
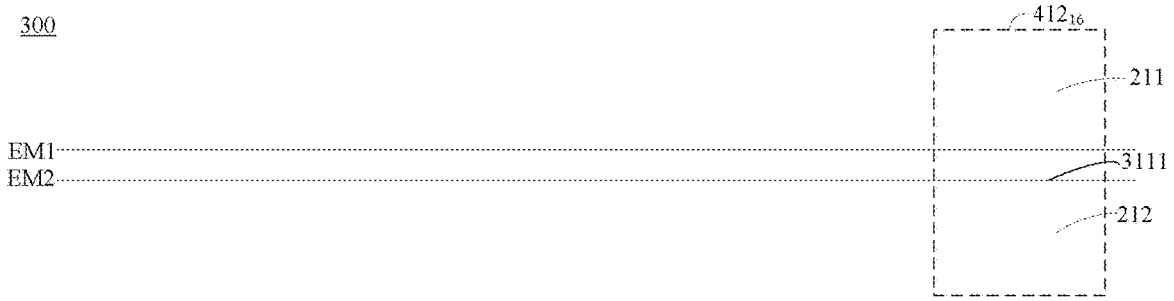
FIG. 14 is a distribution diagram of protrusions of light-emitting units in an anode layer in the related art.

FIG. 14 shows a partial plan view of a display substrate used in the related art. Protrusions of the light-emitting units located in a same row in the anode layer are coupled to the light-emitting driving signal lines corresponding to the same row. Protrusions of the light-emitting units in different rows in the anode layer are coupled to different light-emitting driving signal lines. For example, as shown in FIG. 14, a protrusion 3111 of a light-emitting unit 211 in a pixel circuit multiplexing unit $\mathbf{412}_{16}$ located in a first row in the anode layer 240 is coupled to a light-emitting driving signal line EM1 corresponding to the first row, and a protrusion 3111 of a light-emitting unit 212 in a pixel circuit multiplexing unit $\mathbf{412}_{16}$ located in a second row in the anode layer 240 is coupled to a light-emitting driving signal line EM2 corresponding to the second row. It may be seen from FIG. 14 that a protrusion 3111 of each light-emitting unit in the anode layer 240 has a same length in an extension direction.

Figure 15:
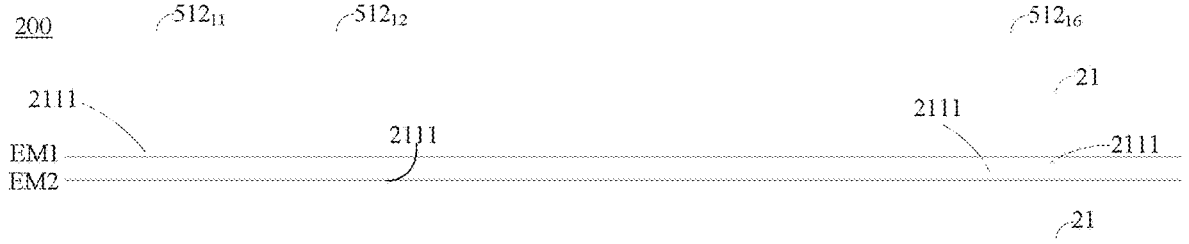
FIG. 15 is a distribution diagram of protrusions of light-emitting units in an anode layer according to the embodiments of the present disclosure.
Figure 21:
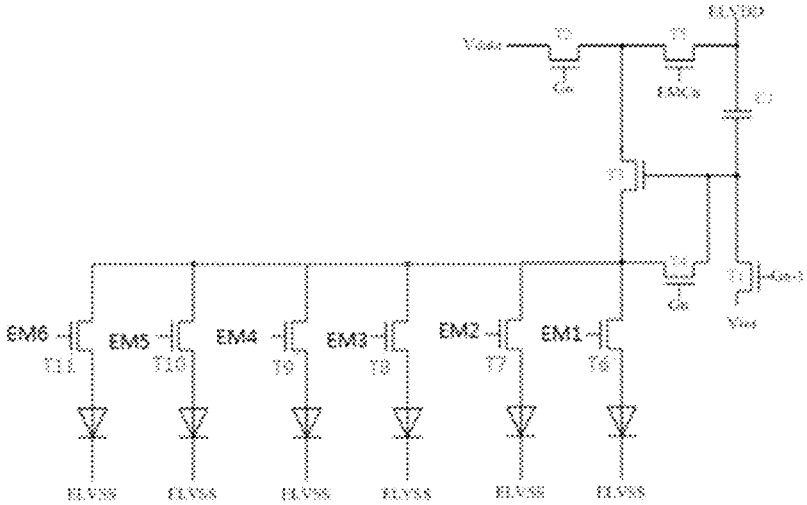
FIG. 21 is a circuit diagram of a pixel circuit according to the embodiments of the present disclosure.

FIG. 15 shows a partial plan view of a display substrate according to the embodiments of the present disclosure. In some embodiments of the present disclosure, as shown in FIG. 21 and FIG. 15, each of the N light-emitting units includes: a third transistor having a gate coupled to one of the plurality of light-emitting driving signal lines, and a first electrode coupled to one of the plurality of pixel driving circuits; and a light-emitting device having an anode coupled to a second electrode of the third transistor, and a cathode coupled to a reference signal line ELVSS. The gate of the third transistor is arranged in the gate layer of the display substrate, the first electrode of the third transistor and the second electrode of the third transistor are arranged in the source or the drain layer of the display substrate, and the anode of the light-emitting device is arranged in the anode layer of the display substrate; and the anode of the light-emitting device has a protrusion in the anode layer, and the protrusion extends to one of the plurality of light-emitting driving signal lines, and is coupled to the second electrode of the third transistor in the source or the drain layer through a via hole.

A protrusion of a light-emitting unit located in an even column and an odd row in the anode layer extends to a next row, so as to couple to a light-emitting driving signal line EM2 corresponding to the next row. A protrusion of a light-emitting unit located in an even row and an even column in the anode layer extends to a previous row, so as to couple to a light-emitting driving signal line EM1 corresponding to the previous row. For example, as shown in FIG. 15, a protrusion 2111 of a light-emitting unit 211 in a pixel circuit multiplexing unit $\mathbf{512}_{16}$ located in a first row in the anode layer 240 is coupled to a light-emitting driving signal line EM2 corresponding to the second row, and a protrusion 3111 of a light-emitting unit 212 in a pixel circuit multiplexing unit $\mathbf{512}_{16}$ located in a second row in the anode layer 240 is coupled to a light-emitting driving signal line EM1 corresponding to the first row.

As shown in FIG. 15, a length of a protrusion 2111 in the anode layer 240 in a pixel circuit multiplexing unit $\mathbf{512}_{11}$ located in the first row and the first column of the first array is different from a length of a protrusion 2111 in the anode layer 240 in a pixel circuit multiplexing unit $\mathbf{512}_{12}$ located in the second column and the first row of the first array in an extension direction.

In the embodiments of the present disclosure, by extending a protrusion of a light-emitting unit located in an odd row and an even column in the anode layer to the next row, and extending a protrusion of a light-emitting unit located in an even row and an even column in the anode layer to the previous row, the extended protrusions of the light-emitting units in the anode layer may be cross distributed, so that two adjacent light-emitting units in a same row may be coupled to one of the light-emitting driving signal lines, such as EM1 or EM2, so as to realize that two light-emitting units in a same pixel circuit multiplexing unit emit light in sequence during one frame period, and two adjacent light-emitting units in a same row emit light in sequence during one frame period, so as to realize the decomposition display of the image in the horizontal and vertical directions, and reduce the display flicker.

According to the pixel circuit provided by the embodiments of the present disclosure, N light-emitting units in a same pixel circuit multiplexing unit emit light in sequence during one frame period. N adjacent light-emitting units in a same row emit light in sequence during one frame period, which may realize the decomposition display of the image in the horizontal and vertical directions and reduce the display flicker. In addition, as shown in FIG. 8, a pixel circuit 111 may include: a plurality of pixel driving circuits 11; a plurality of pixel circuit multiplexing units 12 corresponds to the pixel driving circuits 11 one by one. A pixel circuit multiplexing unit 12 is coupled to a corresponding pixel driving circuit 11. The pixel circuit multiplexing unit 12 includes N light-emitting units 21. N/2 light-emitting units 21 are located in an $m^{th}$ column to an $(m+i)^{th}$ column, respectively, and located in an $n^{th}$ row, and the other N/2 light-emitting units 21 are located in the $m^{th}$ column to the $(m+i)^{th}$ column, respectively, and located in an $(n+1)^{th}$ row, N is an even number greater than 2, n is an odd number, i is equal to N/2−1.

In the embodiments of the present disclosure, as shown in FIG. 8, the N light-emitting units 21 in the pixel circuit multiplexing unit 12 are arranged in two rows, that is, an $n^{th}$ row (odd row) and an $(n+1)^{th}$ row (even row). N/2 light-emitting units 21 are located in the $n^{th}$ row, and N/2 light-emitting units 21 are located in the $(n+1)^{th}$ row. All light-emitting units 21 in a same row emit light at different times, and all light-emitting units 21 in a same column emit light at different times. N light-emitting units 21 in a same pixel circuit multiplexing unit 12 emit light in sequence during one frame period. The light emitting units at corresponding positions in the pixel circuit multiplexing unit located in a same row emit light at the same time. The N light-emitting units in a same pixel circuit multiplexing unit may be controlled to emit light in an order of row-first and column-second or in other orders. According to the order of row-first and column-second, that is, the N/2 light-emitting units located in the $n^{th}$ row emit light first, and the N/2 light-emitting units located in the $(n+1)^{th}$ row emit light later, and the N/2 light-emitting units in a same row emit light in sequence in columns, so as to realize the 1:N pixel multiplexing scheme. Since N is an even number greater than 2, the embodiments of the present disclosure may implement pixel multiplexing schemes such as 1:4, 1:6 . . . pixel multiplexing schemes.

Figure 16:
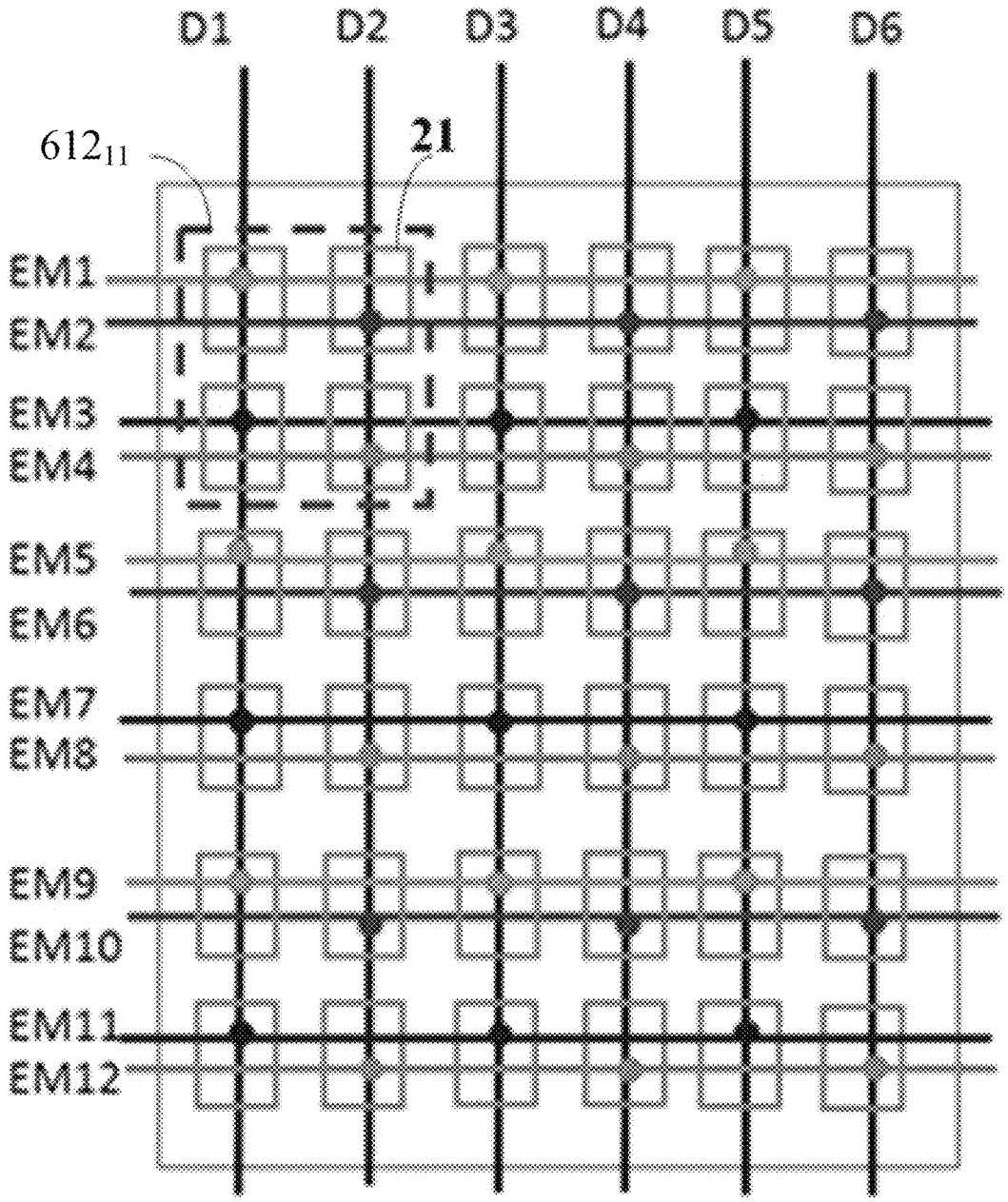
FIG. 16 is an arrangement and a light-emitting sequence of light-emitting units according to the embodiments of the present disclosure.
Figure 17:
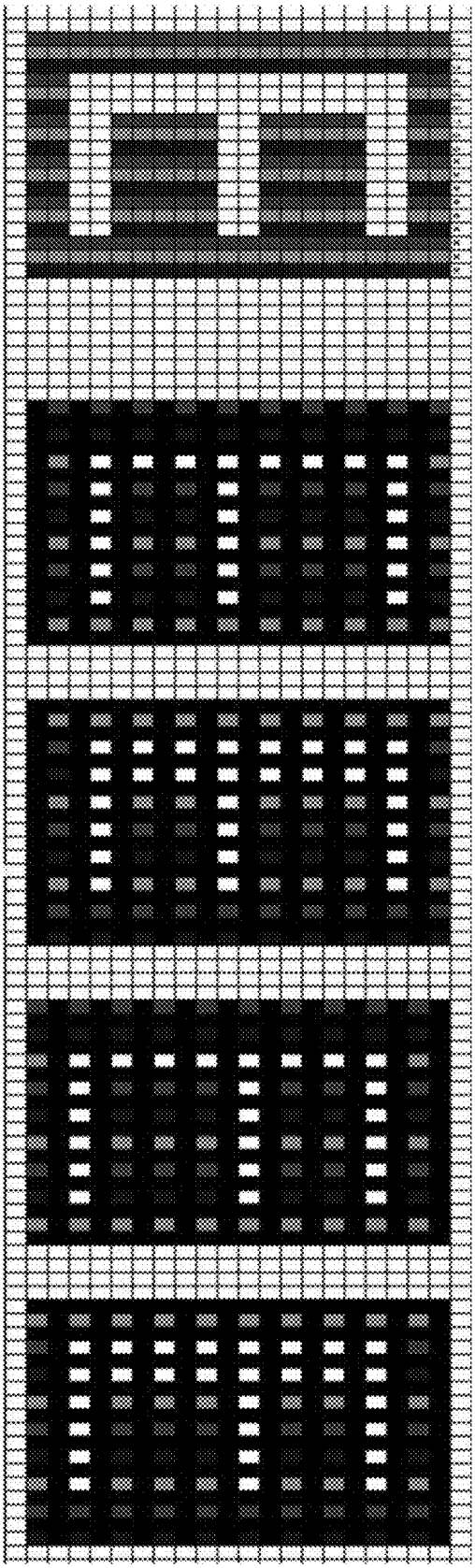
FIG. 17 is an image decomposition diagram according to the embodiments of the present disclosure.

For example, in the 1:4 pixel multiplexing scheme, the N light-emitting units in a same pixel circuit multiplexing unit emit light in the order of row-first and column-second, N=4, i=1, and the plurality of pixel circuit multiplexing units 612 may be arranged as shown in FIG. 16. Four light-emitting units 21 in a same pixel circuit multiplexing unit emit light in the order of row-first and column-second during one frame period, and the light-emitting units 21 at corresponding positions in the pixel circuit multiplexing unit 612 located in a same row emit light at the same time. As shown in FIG. 16, the light-emitting units 21 with the same identification emit light at the same time (that is, the light-emitting units 21 with an identification 1 emit light at the same time, the light-emitting units 21 with an identification 2 emit light at the same time, the light-emitting units 21 with an identification 3 emit light at the same time, and the light-emitting units 21 with an identification 4 emit light at the same time). The light-emitting units 21 with the identification 1, the identification 2, the identification 3 and the identification 4 emit light in sequence. The display appearance is shown in FIG. 17, which may realize the decomposition display of the image in the horizontal and vertical directions, and reduce the display flicker.

As shown in FIG. 11, the pixel driving circuit 11 includes TFTs T1, T2, T3, T4, T5 and a capacitor C1.

According to the pixel circuit provided by the embodiments of the present disclosure, the pixel circuit multiplexing unit corresponds to the pixel driving circuit one by one, and the pixel circuit multiplexing unit is coupled to the corresponding pixel driving circuit. The pixel circuit multiplexing unit includes N light-emitting units. N/2 light-emitting units are located in an $m^{th}$ column to an $(m+i)^{th}$ column, respectively, and located in an $n^{th}$ row, and the other N/2 light-emitting units are located in the $m^{th}$ column to the $(m+i)^{th}$ column, respectively, and located in an $(n+1)^{th}$ row, N is an even number greater than 2, n is an odd number, i is equal to N/2−1. The N light-emitting units in a same pixel circuit multiplexing unit emit light in sequence during one frame period, and the light-emitting units at the corresponding positions in the pixel circuit multiplexing unit located in a same row emit light at the same time, which may realize the decomposition display of the image in the horizontal and vertical directions, and reduce the display flicker.

In some embodiments, the display substrate may include: N light-emitting driving signal lines coupled to N light-emitting units in one-to-one correspondence. The light-emitting units at corresponding positions in the pixel circuit multiplexing unit in a same row are coupled to a same light-emitting driving signal line.

Figure 18:
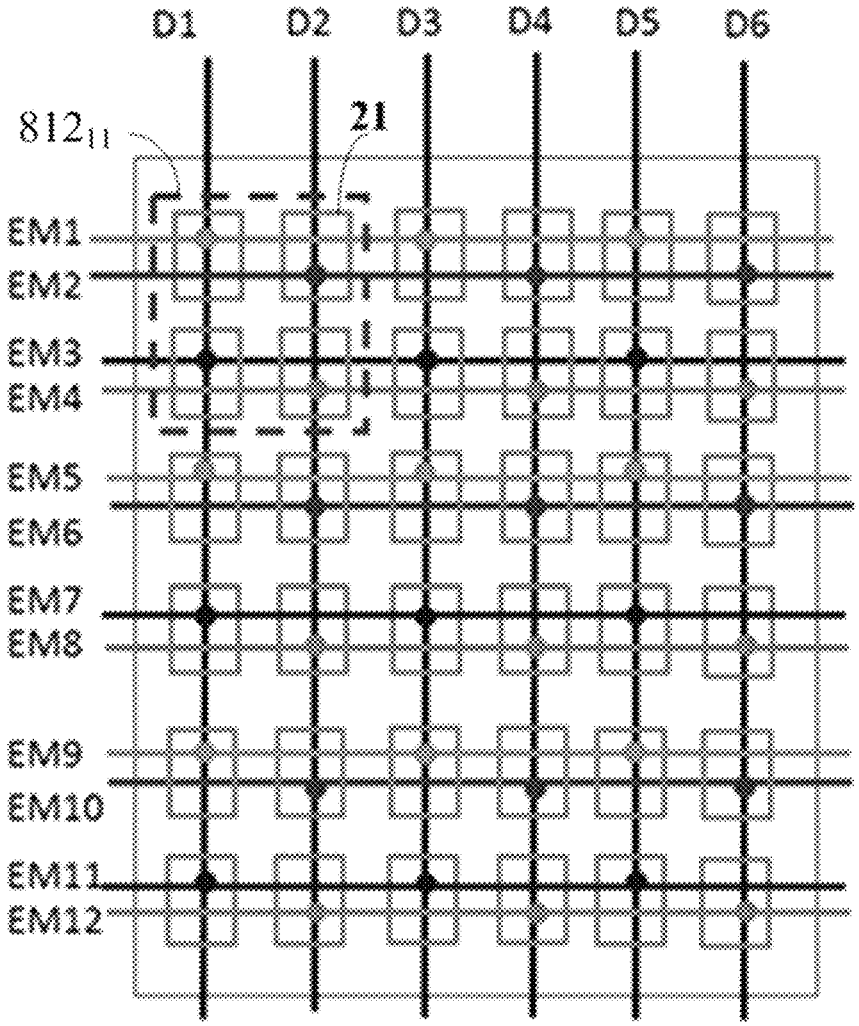
FIG. 18 is a structural diagram of a pixel circuit multiplexing unit according to the embodiments of the present disclosure.
Figure 19:
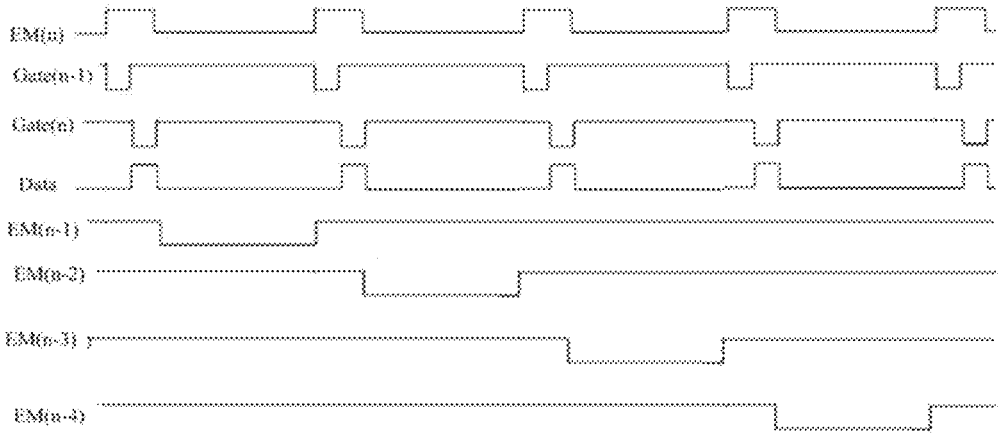
FIG. 19 is an operating sequence of a pixel circuit according to the embodiments of the present disclosure.
Figure 20:
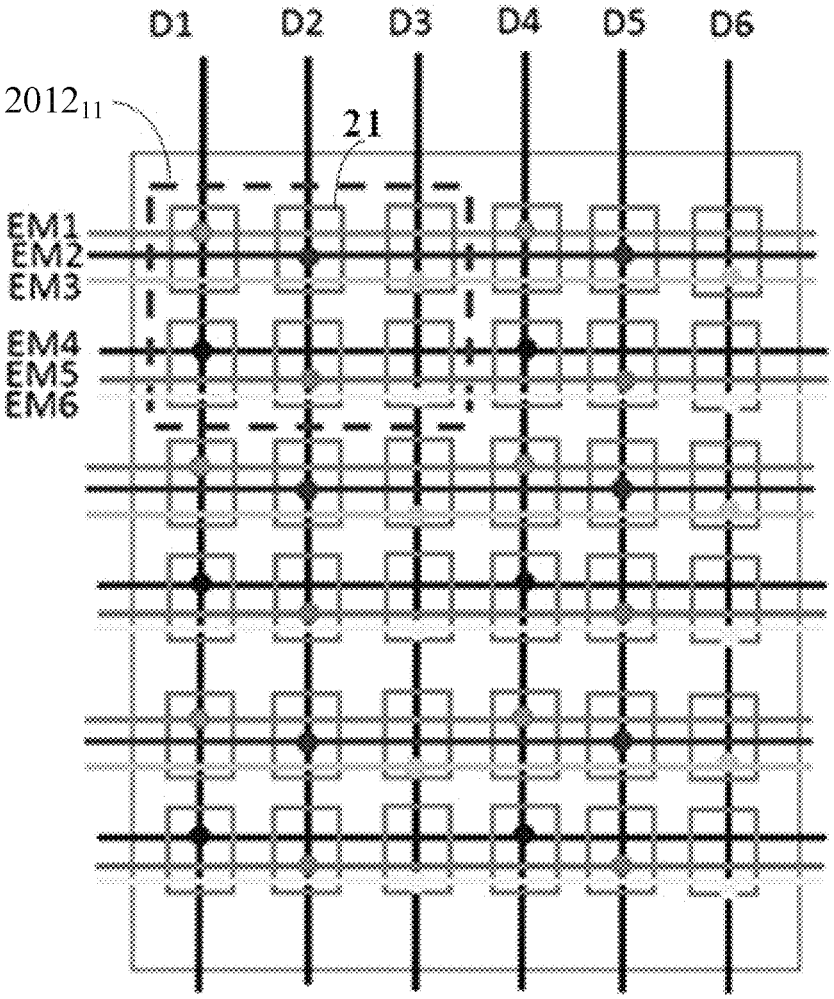
FIG. 20 is a structural diagram of a pixel circuit multiplexing unit according to the embodiments of the present disclosure.
Figure 22:
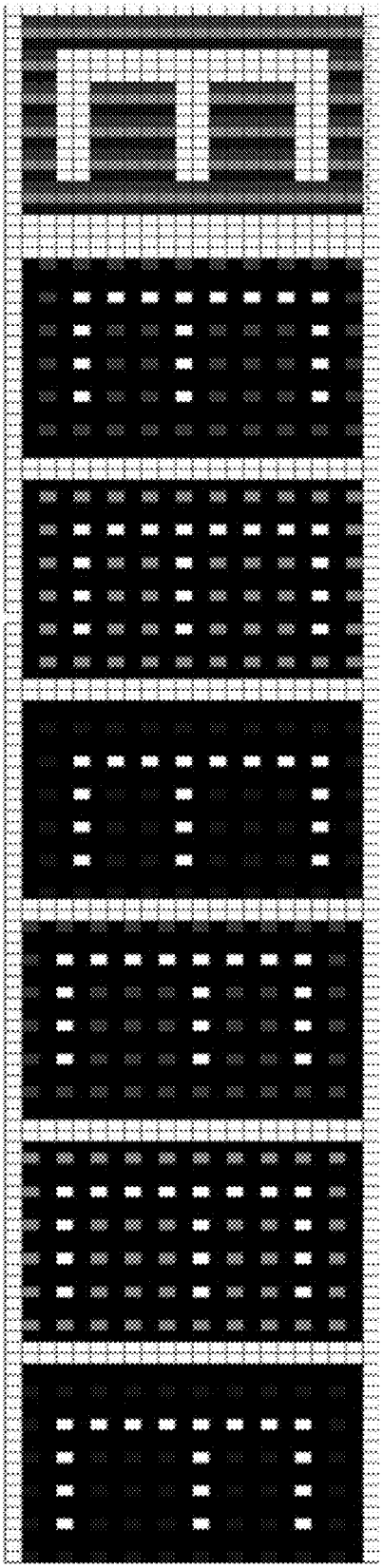
FIG. 22 is an image decomposition diagram according to the embodiments of the present disclosure.

For example, in the 1:4 pixel multiplexing scheme, as shown in FIG. 18, a pixel circuit multiplexing unit $\mathbf{812}_{11}$ includes: four light-emitting units 21 coupled to four light-emitting driving signal lines, such as EM1, EM2, EM3 and EM4, in one-to-one correspondence. Light-emitting units at corresponding positions in pixel circuit multiplexing units located in a same row are coupled to a same light-emitting driving signal line, and the light-emitting units at the corresponding positions are arranged with one light-emitting unit spaced apart. An operating sequence of these light-emitting units is shown in FIG. 19, so that four light-emitting units in a same pixel circuit multiplexing unit may emit light in sequence during one frame period. The light-emitting units 21 at corresponding positions in the pixel circuit multiplexing unit in a same row emit light at the same time, so as to realize the decomposition display of the image in the horizontal and vertical directions, and reduce the display flicker. For example, in the 1:6 pixel multiplexing scheme, as shown in FIG. 20, a pixel circuit multiplexing unit $\mathbf{2012}_{11}$ includes six light-emitting units 21 coupled to six light-emitting driving signal lines, such as EM1, EM2, EM3, EM4, EM5 and EM6, in one-to-one correspondence. Light-emitting units at corresponding positions in pixel circuit multiplexing units located in a same row are coupled to a same light-emitting driving signal line, and the light-emitting units at the corresponding positions are arranged with two light-emitting units spaced apart. A circuit diagram of the pixel circuit is shown in FIG. 21, so that the six light-emitting units in a same pixel circuit multiplexing unit emit light in sequence during one frame period, and the light-emitting units at the corresponding positions in the pixel circuit multiplexing unit located in a same row emit light at the same time. The display appearance is shown in FIG. 22, so as to realize the decomposition display of the image in the horizontal and vertical directions, and reduce the display flicker.

According to the pixel circuit provided by the embodiments of the present disclosure, N light-emitting units in a same pixel circuit multiplexing unit emit light in sequence during one frame period. Light-emitting units at corresponding positions in a pixel circuit multiplexing unit located in a same row emit light at the same time, which may realize the decomposition display of the image in the horizontal and vertical directions, and reduce the display flicker.

In some embodiments, in the 1:4 and 1:6 pixel multiplexing schemes, a length of a protrusion in the anode layer located in the $i^{th}$ row and the $j^{th}$ column in an extension direction is different from a length of a protrusion in the anode layer located in the $i^{th}$ row and the $(j+1)^{th}$ column in an extension direction.

In some embodiments, the display substrate further includes a plurality of groups of light-emitting control lines, and the each pixel circuit multiplexing unit is coupled to a group of light-emitting control lines, and each control line group comprises M light-emitting control lines. The N light-emitting units in the pixel circuit multiplexing unit are divided into M groups of light-emitting units. The pixel circuit multiplexing unit further comprises M switching circuits. An $m^{th}$ switching circuit is coupled to an $m^{th}$ light-emitting control line, an $m^{th}$ group of light-emitting units and a pixel driving circuit. The $m^{th}$ switching circuit is configured to provide a driving current generated by the pixel driving circuit to the $m^{th}$ group of light-emitting units under control of an $m^{th}$ light-emitting control signal from the $m^{th}$ light-emitting control line, and M is an integer greater than 1, m is an integer, and $1 \leq m \leq M$.

In some embodiments, M=2, the M light-emitting control lines include a first light-emitting control line and a second light-emitting control line. The M groups of light-emitting units are divided into a first group of light-emitting units and a second group of light-emitting units. The M switching circuits include: a first switching circuit coupled to the first light-emitting control line, the first group of light-emitting units and the pixel driving circuit; and a second switching circuit coupled to the second light-emitting control line, the second group of light-emitting units and the pixel driving circuit. The first switching circuit is configured to provide a driving current generated by the pixel driving circuit to the first group of light-emitting units under control of a first light-emitting control signal from the first light-emitting control line. The second switching circuit is configured to provide a driving current generated by the pixel driving circuit to the second group of light-emitting units under control of a second light-emitting control signal from the second light-emitting control line.

In some embodiments, the plurality of light-emitting driving signal lines extend in the second direction and are arranged in the first direction. The first light-emitting control line and the second light-emitting control line extend in the first direction and are arranged in the second direction. A pixel circuit multiplexing unit located in a same column of the first array is coupled to a group of light-emitting driving signal lines, and a pixel circuit multiplexing unit located in a same row of the first array is coupled to a group of light-emitting control lines.

In some embodiments, the first switching circuit includes a first transistor, a gate of the first transistor is coupled to the first light-emitting control line, a first electrode of the first transistor is coupled to the pixel driving circuit, and a second electrode of the first transistor is coupled to the first group of light-emitting units. The second switching circuit includes a second transistor, a gate of the second transistor is coupled to the second light-emitting control line, a first electrode of the second transistor is coupled to the pixel driving circuit, and a second electrode of the second transistor is coupled to the second group of light-emitting units.

Figure 24:
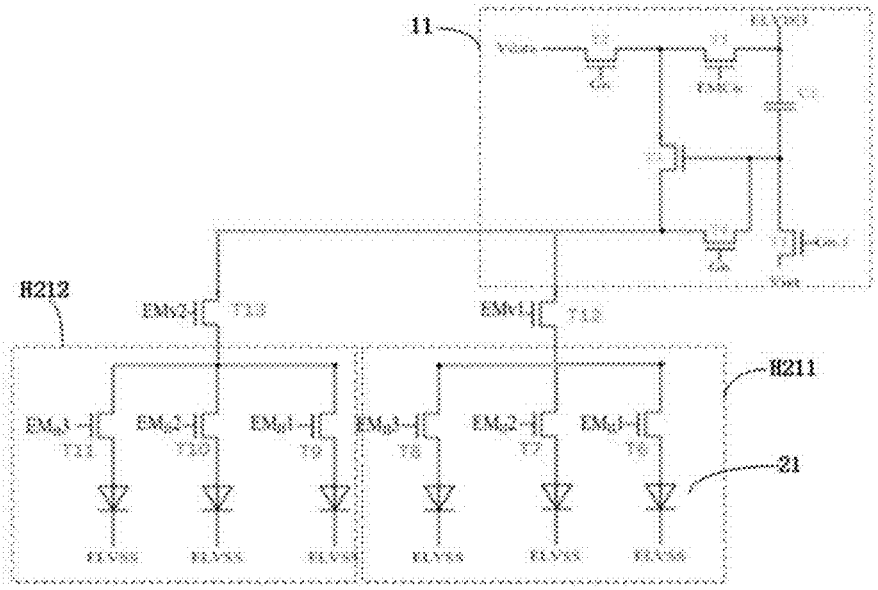
FIG. 24 is a circuit diagram of a pixel circuit according to the embodiments of the present disclosure.

As shown in FIG. 24, the M light-emitting control lines include a first light-emitting control line $EM_V1$ and a second light-emitting control line $EM_V2$. The N light-emitting units 21 in the pixel circuit multiplexing unit 12 are divided into a first group of light-emitting units H211 and a second group of light-emitting units H212.

As shown in FIG. 24, the pixel circuit multiplexing unit further includes a first switching circuit and a second switching circuit.

The first switching circuit includes the first transistor T12. The gate of the first transistor T12 is coupled to the first light-emitting control line $EM_V1$, the first electrode of the first transistor T12 is coupled to the pixel driving circuit 11, and the second electrode of the first transistor T12 is coupled to the first group of light-emitting units H211. The second switching circuit includes the second transistor T13. The gate of the second transistor T13 is coupled to the second light-emitting control line $EM_V2$, the first electrode of the second transistor T13 is coupled to the pixel driving circuit 11, and the second electrode of the second transistor T13 is coupled to the second group of light-emitting units H212.

The first transistor T12 is coupled to the first light-emitting control line $EM_V1$, the first group of light-emitting units H211 and the pixel driving circuit 11, and is configured to provide a driving current generated by the pixel driving circuit 11 to the first group of light-emitting units H211 under control of a first light-emitting control signal from the first light-emitting control line $EM_V1$. The second transistor T13 is coupled to the second light-emitting control line $EM_V2$, the second group of light-emitting units H212 and the pixel driving circuit 11, and is configured to provide a driving current generated by the pixel driving circuit 11 to the second group of light-emitting units H212 under control of a second light-emitting control signal from the second light-emitting control line $EM_V2$.

Figure 23:
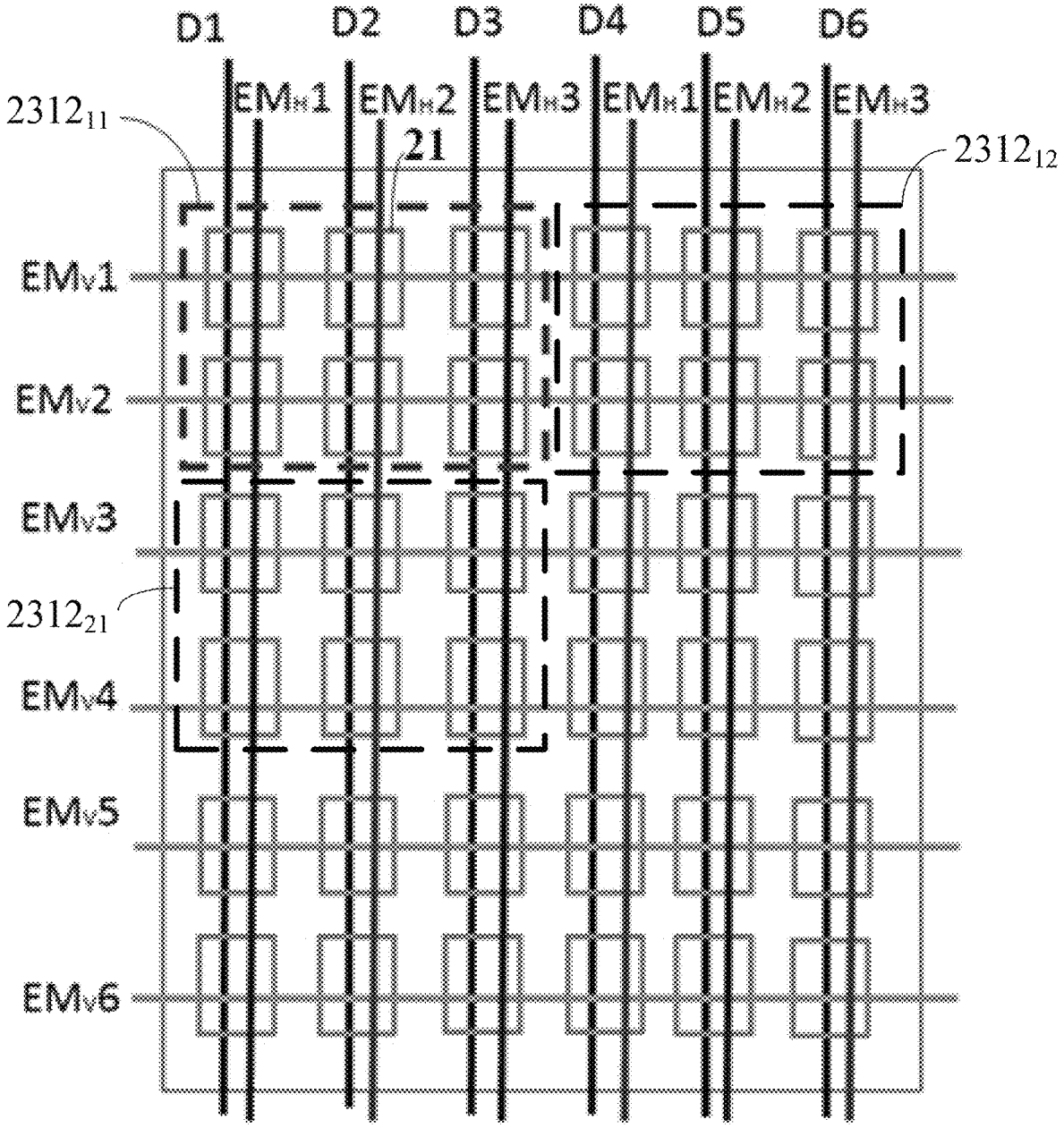
FIG. 23 is a structural diagram of a pixel circuit multiplexing unit according to the embodiments of the present disclosure.

As shown in FIG. 23, the plurality of light-emitting driving signal lines (also called row light-emitting driving signal lines), such as $EM_H1$, $EM_H2$ and $EM_H3$, extend in the second direction (a row direction) and arrange in the first direction. The first light-emitting control line $EM_V1$ and the second light-emitting control line $EM_V2$ (also called column light-emitting driving signal lines) extend in the first direction and arrange in the second direction (a column direction).

In some embodiments, as shown in FIG. 23, pixel circuit multiplexing units (including a pixel circuit multiplexing unit $2312_{11}$ and a pixel circuit multiplexing unit located in a same column, for example, a pixel circuit multiplexing unit $2312_{21}$) located in a same column (for example, the first column) of the first array are coupled to the light-emitting driving signal lines $EM_H1$, $EM_H2$ and $EM_H3$. Pixel circuit multiplexing units (including the pixel circuit multiplexing unit $2312_{11}$ and a pixel circuit multiplexing unit located in a same row, for example, a pixel circuit multiplexing unit $2312_{12}$) located in a same row (for example, the first row) of the first array is coupled to the first light-emitting control line (for example, $EM_V1$) and the second light-emitting control line (for example, $EM_V2$).

The N/2 column light-emitting driving signal lines are coupled to the N/2 light-emitting units one by one. The N/2 column light-emitting driving signal lines are further coupled to the other N/2 light-emitting units one by one. The light-emitting units at corresponding positions in the pixel circuit multiplexing unit located in a same column are coupled to the same column light-emitting driving signal lines.

Further, as another feasible implementation, the pixel circuit multiplexing unit may further include: two row light-emitting driving signal lines. One of the two row light-emitting driving signal lines is coupled to a control terminal of the first transistor, and another of the two row light-emitting driving signal lines is coupled to a control terminal of the second transistor. The control terminals of the switching circuits at the corresponding positions in the pixel circuit multiplexing units located in a same row are coupled to a light-emitting driving signal line located in the same row.

In some embodiments, for example, when N=6, the pixel circuit multiplexing unit may be as shown in FIG. 23 and FIG. 24, including: the first transistor T12 and the second transistor T13. Three light-emitting units 21 are coupled to the pixel driving circuit 11 through the first transistor T12, and the other three light-emitting units 21 are coupled to the pixel driving circuit 11 through the second transistor T13.

The three column light-emitting driving signal lines, such as $EM_H1$, $EM_H2$ and $EM_H3$, are coupled to the three light-emitting units 21 in a same row one by one, the three column light-emitting driving signal lines, such as $EM_H1$, $EM_H2$ and $EM_H3$, are also coupled to the other three light-emitting units 21 in the next row one by one. The light-emitting units 21 at corresponding positions in the pixel circuit multiplexing unit 12 located in a same column are coupled to the same column light-emitting driving signal lines.

One of the two row light-emitting driving signal lines (such as $EM_V1$ and $EM_V2$), such as $EM_V1$, is coupled to the control terminal of the first transistor T12, and another of the two row light-emitting driving signal lines, such as $EM_V2$, is coupled to the control terminal of the second transistor T13. The control terminals of the switching circuits at the corresponding positions in the pixel circuit multiplexing units located in a same row are coupled to a same row light-emitting driving signal line. Thus, the six light-emitting units in a same pixel circuit multiplexing unit emit light in sequence during one frame period, and the light-emitting units at corresponding positions in the pixel circuit multiplexing units located in a same row emit light at the same time. The display appearance is as shown in FIG. 22, so as to realize the decomposition display of the image in the horizontal and vertical directions, and reduce the display flicker.

According to the pixel circuit provided by the embodiments of the present disclosure, N light-emitting units in a same pixel circuit multiplexing unit emit light in sequence during one frame period, and the light-emitting units at corresponding positions in the pixel circuit multiplexing units located in a same row emit light at the same time, which may realize the decomposition display of the image in the horizontal and vertical directions, and reduce the display flicker.

Figure 25:
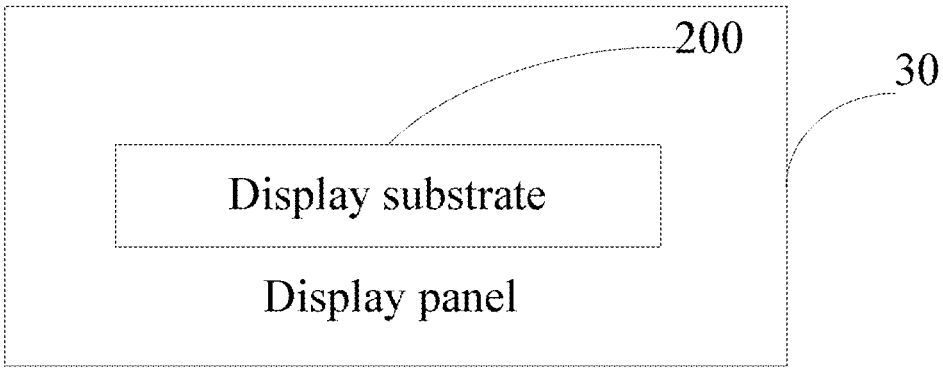
FIG. 25 is a structural diagram of a display panel according to the embodiments of the present disclosure.

In order to realize the embodiments described above, the embodiments of the present disclosure further provides a display panel 30, as shown in FIG. 25, including a display substrate 200 according to the embodiments described above.

Figure 26:
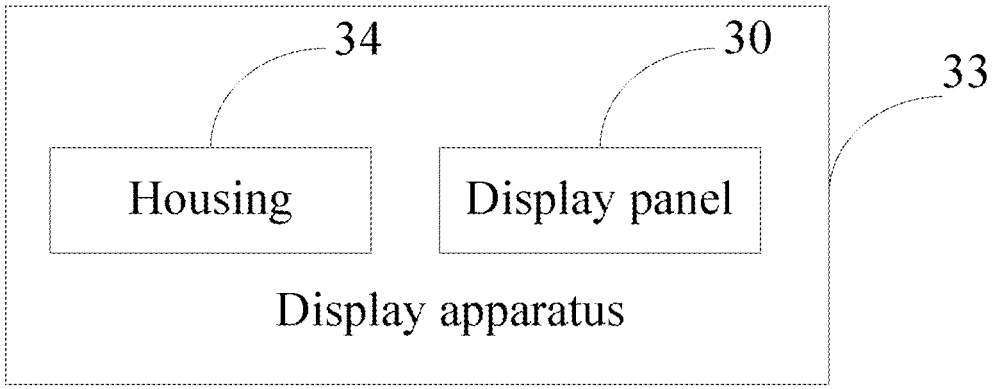
FIG. 26 is a structural diagram of a display apparatus according to the embodiments of the present disclosure.

In order to realize the embodiments described above, the embodiments of the present disclosure further provides a display apparatus 33, as shown in FIG. 26, including: a display panel 30 and a housing 34 as shown in the embodiments described above, which are arranged outside the display panel 30.

In the description of the present disclosure, the expressions of the terms "an embodiment", "some embodiments", "an example", or "some examples" mean that features, structures, materials, or characteristics described in conjunction with the embodiments or examples are included in at least one embodiment or example of the present disclosure. In the present disclosure, the illustrative expressions of the above terms need not refer to the same embodiments or examples. Moreover, the described features, structures, materials or characteristics may be combined in a suitable manner in any one or more embodiments or examples. In addition, without contradiction, those skilled in the art may combine and group the different embodiments or examples and the features of the different embodiments or examples described in the present disclosure.

Although the embodiments of the present disclosure have been shown and described above, it is understandable that the embodiments described above are exemplary and cannot be understood as a limitation of the present disclosure, and those ordinary skilled in the art may change, modify, replace and vary the embodiments described above within the scope of the present disclosure.

What is claimed is:

1. A display substrate, comprising:

a plurality of pixel driving circuits;

a plurality of groups of light-emitting driving signal lines, wherein each driving signal line group of the plurality of groups of light-emitting driving signal lines comprises a plurality of light-emitting driving signal lines; and a plurality of pixel circuit multiplexing units coupled to the plurality of pixel driving circuits, respectively, wherein the plurality of pixel circuit multiplexing units are arranged in a first array of D×E, and D and E are integers greater than 1, wherein each pixel circuit multiplexing unit of the plurality of pixel circuit multiplexing unit comprises N light-emitting units arranged in a second array of K×H, wherein K, H and N are integers greater than 1, and the N light-emitting units are coupled to one of the plurality of groups of light-emitting driving signal lines; and wherein each light-emitting unit of the N light-emitting units is configured to receive a driving signal from a pixel driving circuit coupled to the each light-emitting unit, under control of a light-emitting driving signal from a light-emitting driving signal line coupled to the each light-emitting unit, so that all light-emitting units located in a same row do not emit light at the same time, all light-emitting units located in a same column emit light at different times, and the N light-emitting units in a same pixel circuit multiplexing unit emit light in sequence during one frame period, wherein the ach light emitting unit of the N light-emitting units comprises:

a driving transistor having a gate coupled to one of the plurality of light-emitting driving signal lines, and a first electrode coupled to one of the plurality of pixel driving circuits; and a light-emitting device having an anode coupled to a second electrode of the driving transistor, and a cathode coupled to a reference signal line, wherein the gate of the driving transistor is arranged in a gate layer of the display substrate, the first electrode of the driving transistor and the second electrode of the driving transistor are arranged in a source or a drain layer of the display substrate, and the anode of the light-emitting device is arranged in an anode layer of the display substrate; and wherein the anode of the light-emitting device comprises a protrusion in the anode layer, and wherein the protrusion extends to one of the plurality of light-emitting driving signal lines, and s coupled the second electrode of the driving transistor in the source/drain layer through a via hole, wherein a length of a protrusion of an anode of a light-emitting device located in a row and a column is different from a length of a protrusion of an anode of a light-emitting device located in the same row and an adjacent column.

2. The display substrate according to claim 1, wherein the plurality of pixel circuit multiplexing units are coupled to the plurality of pixel driving circuits in one-to-one correspondence, and the N light-emitting units in the each pixel circuit multiplexing unit are coupled to a same pixel driving circuit in the plurality of pixel driving circuits.

3. The display substrate according to claim 2, wherein the each driving signal line group comprises N light-emitting driving signal lines; and wherein the N light-emitting driving signal lines extend in a first direction and are arranged in a second direction, and the first direction is a row direction of the first array and the second array, and the second direction is a column direction of the first array and the second array; and wherein pixel circuit multiplexing units located in a same row of the first array are coupled to a group of light-emitting driving signal lines.

4. The display substrate according to claim 3, wherein N=2, and the each pixel circuit multiplexing unit comprises a first light-emitting unit and a second light-emitting unit arranged in a column, and the N light-emitting driving signal lines comprise a first light-emitting driving signal line and a second light-emitting driving signal line; and wherein a first light-emitting unit in a pixel circuit multiplexing unit located in an $i^{th}$ row and a $j^{th}$ column of the first array and a second light-emitting unit in a pixel circuit multiplexing unit located in the $i^{th}$ row and a $(j+1)^{th}$ column of the first array are coupled to the first light-emitting driving signal line, wherein i and j are integers, and $1 \le i \le D$, $1 \le j \le E$; and a second light-emitting unit in the pixel circuit multiplexing unit located in the $i^{th}$ row and the $j^{th}$ column of the first array and a first light-emitting unit in pixel circuit multiplexing unit located in the $i^{th}$ row and the $(j+1)^{th}$ column of the first array are coupled to the second light-emitting driving signal line.

5. The display substrate according to claim 4, wherein the first light-emitting driving signal line and the second light-emitting driving signal line are in a linear shape and extend in the first direction; and wherein the first light-emitting unit in the pixel circuit multiplexing unit located in an $i^{th}$ row and a $j^{th}$ column of the first array and the second light-emitting unit in the pixel circuit multiplexing unit located in the $i^{th}$ row and a $(j+1)^{th}$ column of the first array are coupled to the first light-emitting driving signal line through a via hole, wherein i and j are integers, and $1 \le i \le D$, $1 \le j \le E$; and the second light-emitting unit in the pixel circuit multiplexing unit located in the $i^{th}$ row and the $j^{th}$ column of the first array and the first light-emitting unit in the pixel circuit multiplexing unit located in the $i^{th}$ row and the $(j+1)^{th}$ column of the first array are coupled to the second light-emitting driving signal line through a via hole.

6. The display substrate according to claim 4, wherein, the first light-emitting driving signal line is in a first zigzag shape and extends in the first direction, so as to couple to the first light-emitting unit in the pixel circuit multiplexing unit located in the $i^{th}$ row and the $j^{th}$ column and the second light-emitting unit in the pixel circuit multiplexing unit located in the $i^{th}$ row and the $(j+1)^{th}$ column; and the second light-emitting driving signal line is in a second zigzag shape and extends in the first direction, so as to couple to the second light-emitting unit in the pixel circuit multiplexing unit located in the $i^{th}$ row and the $j^{th}$ column and the first light-emitting unit in the pixel circuit multiplexing unit located in the $i^{th}$ row and the $(j+1)^{th}$ column.

7. The display substrate according to claim 3, wherein N is an even number greater than 2, and the N light-emitting driving signal lines in the each driving signal line group are arranged in the second direction in an order from the first light-emitting driving signal line to the $N^{th}$ light-emitting driving signal line; and wherein a light-emitting unit located in a $k^{th}$ row and an $h^{th}$ column of the second array is coupled to an $n^{th}$ light-emitting driving signal line in the N light-emitting driving signal lines, wherein k, h and N are integers greater than 1, $1 \leq k \leq K$, $1 \leq h \leq H$, and $n=(k-1)H+h$.

8. The display substrate according to claim 2, further comprising:

a plurality of groups of light-emitting control lines, wherein the each pixel circuit multiplexing unit is coupled to a group of light-emitting control lines, and each control line group comprises M light-emitting control lines; and wherein the N light-emitting units in the pixel circuit multiplexing unit are divided into M groups of light-emitting units, and the pixel circuit multiplexing unit further comprises M switching circuits; and wherein an $m^{th}$ switching circuit is coupled to an $m^{th}$ light-emitting control line, an $m^{th}$ group of light-emitting units and a pixel driving circuit, and the $m^{th}$ switching circuit is configured to provide a driving current generated by the pixel driving circuit to the $m^{th}$ group of light-emitting units under control of an $m^{th}$ light-emitting control signal from the $m^{th}$ light-emitting control line, wherein M is an integer greater than 1, m is an integer, and $1 \leq m \leq M$.

9. The display substrate according to claim 8, wherein, the plurality of light-emitting driving signal lines extend in the second direction and are arranged in the first direction, and the M light-emitting control lines extend in the first direction and are arranged in the second direction; and wherein a pixel circuit multiplexing unit located in a same column of the first array is coupled to a group of light-emitting driving signal lines, and a pixel circuit multiplexing unit located in a same row of the first array is coupled to a group of light-emitting control lines.

10. The display substrate according to claim 9, wherein M=2, the M light-emitting control lines comprise a first light-emitting control line and a second light-emitting control line; and wherein the M groups of the light-emitting units comprises a first group of light-emitting units and a second group of the light-emitting units, and the M switching circuits comprise a first switching circuit and a second switching circuit; and wherein the first switching circuit comprises a first transistor, a gate of the first transistor is coupled to the first light-emitting control line, a first electrode of the first transistor is coupled to the pixel driving circuit, and a second electrode of the first transistor is coupled to the first group of the light-emitting units; and the second switching circuit comprises a second transistor, a gate of the second transistor is coupled to the second light-emitting control line, a first electrode of the second transistor is coupled to the pixel driving circuit, and a second electrode of the second transistor is coupled to the second group of the light-emitting units.

11. The display substrate according to claim 8, wherein M=2, the M light-emitting control lines comprise a first light-emitting control line and a second light-emitting control line; and wherein the M groups of the light-emitting units comprises a first group of light-emitting units and a second group of the light-emitting units, and the M switching circuits comprise a first switching circuit and a second switching circuit; and wherein the first switching circuit comprises a first transistor, a gate of the first transistor is coupled to the first light-emitting control line, a first electrode of the first transistor is coupled to the pixel driving circuit, and a second electrode of the first transistor is coupled to the first group of the light-emitting units; and the second switching circuit comprises a second transistor, a gate of the second transistor is coupled to the second light-emitting control line, a first electrode of the second transistor is coupled to the pixel driving circuit, and a second electrode of the second transistor is coupled to the second group of the light-emitting units.

12. A display panel, comprising a display substrate according to claim 1.

13. A display apparatus, comprising the display panel according to claim 12.

* * * * *